US007482742B2

(12) United States Patent
Sando et al.

(10) Patent No.: US 7,482,742 B2
(45) Date of Patent: Jan. 27, 2009

(54) ELECTRON SOURCE SUBSTRATE WITH HIGH-IMPEDANCE PORTION, AND IMAGE-FORMING APPARATUS

(75) Inventors: Kazuhiro Sando, Kanagawa-Ken (JP); Kunio Takada, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 612 days.

(21) Appl. No.: 11/065,158

(22) Filed: Feb. 25, 2005

(65) Prior Publication Data

US 2005/0200259 A1 Sep. 15, 2005

(30) Foreign Application Priority Data

Mar. 10, 2004 (JP) ..... 2004-066554
Mar. 11, 2004 (JP) ..... 2004-068376

(51) Int. Cl.
*H01J 1/62* (2006.01)
*H01J 63/04* (2006.01)

(52) U.S. Cl. ..... 313/495; 313/309; 313/346 R; 313/310

(58) Field of Classification Search ..... 313/495–497, 313/309–311, 336, 346 R, 351
See application file for complete search history.

(56) References Cited

U.S. PATENT DOCUMENTS 6,005,334 A 12/1999 Mitome et al. ..... 313/309
6,060,113 A 5/2000 Banno et al. ..... 427/78
6,210,245 B1 4/2001 Sando et al. ..... 445/6
6,220,912 B1 4/2001 Shigeoka et al. ..... 445/24
6,259,191 B1 7/2001 Mitome et al. ..... 313/310
6,441,544 B1 * 8/2002 Ando et al. ..... 313/310
6,514,559 B1 2/2003 Miyamoto et al. ..... 427/78
6,815,001 B1 11/2004 Mishima et al. ..... 427/8
2002/0017856 A1 * 2/2002 Suzuki et al. ..... 313/495
2004/0213897 A1 10/2004 Miyamoto et al. ..... 427/58
2005/0148269 A1 * 7/2005 Uda et al. ..... 445/6
2005/0269936 A1 12/2005 Takada ..... 313/495

FOREIGN PATENT DOCUMENTS

JP 8-180801 7/1996
JP 2002-358874 12/2002

* cited by examiner

*Primary Examiner*—Karabi Guharay
*Assistant Examiner*—Kevin Quarterman
(74) *Attorney, Agent, or Firm*—Fitzpatrick, Cella, Harper & Scinto

(57) ABSTRACT

An electron source substrate including: a substrate; an electron-emitting device having a pair of device electrodes locating on the substrate and an electroconductive thin film which is provided between the device electrodes and has an electron-emitting region; and an antistatic film which is come into contact with at least the pair of device electrodes and covers over an exposed surface of the substrate, wherein a leakage current flowing between the device electrodes in a non-driving mode at a low voltage is suppressed. A high-impedance portion which obstructs the current caused across the pair of device electrodes through the antistatic film is provided in the antistatic film.

7 Claims, 14 Drawing Sheets

ELECTRON SOURCE SUBSTRATE WITH HIGH-IMPEDANCE PORTION, AND IMAGE-FORMING APPARATUS

BACKGROUND OF THE INVENTION

1. Field of the Invention

The invention relates to an electron source substrate having one or a plurality of electron-emitting devices and to an image-forming apparatus using the electron source substrate in which a plurality of electron-emitting devices are arranged in a matrix shape and connected by wirings.

2. Related Background Art

Hitherto, with respect to an electron source substrate in which an electron-emitting device comprising a pair of device electrodes and an electroconductive thin film which is formed over the device electrodes and has an electron-emitting region is formed on an insulative substrate, when the surface of the substrate is charged, electron-emitting characteristics of the electron-emitting device become unstable and a discharge deterioration of the electron-emitting device is caused. Therefore, there has been known a method whereby the surface of the substrate on which the electrodes and the electroconductive thin film have been formed is spray-coated with a coating liquid containing a component material of an antistatic film and baked, thereby forming the antistatic film (for example, refer to Japanese Patent Application Laid-Open Nos. H08-180801 and 2002-358874).

The device electrodes and the electroconductive thin film which construct the electron-emitting device are formed on the substrate on which the antistatic film is formed and, further, X-directional wirings and Y-directional wirings are formed on the electron source substrate which is used for an image-forming apparatus and in which a plurality of electron-emitting devices are matrix-driven. Therefore, such a situation that a thickness of antistatic film near the electron-emitting device increases due to a delicate balance of thicknesses of the device electrodes, the electroconductive thin film, the X-directional wirings, and the Y-directional wirings or the like and a sheet resistance decreases extremely is liable to occur. Particularly, when the antistatic film is spray-coated, distribution of the thickness of antistatic film is liable to occur due to conditions such as surface tension of the coating liquid, a contact angle of the substrate surface as a substratum film, and the like in addition to the above conditions. If the thickness of antistatic film is large and the sheet resistance decreases extremely as mentioned above, even at the time of a low voltage (for example, low voltage at which electron emission regarding the non-selection devices is not caused) in a non-driving mode, a micro current flows, so that there is an problem of an increase in electric power consumption. In the case where such an electron source substrate is used for the image-forming apparatus, a driver IC for driving of a capacity which is larger than an inherently necessary capacity by an amount of such a leakage current has to be used, resulting in an increase in costs.

Particularly, it has been found that in the antistatic film near the electron-emitting region, an influence of the increase in leakage current mentioned above is large. This point will be described with reference to FIG. 22.

In FIG. 22, reference numeral 1 denotes an insulative substrate; 2 and 3 a pair of device electrodes; 4 an electroconductive thin film formed over the device electrodes 2 and 3; 5 a gap serving as an electron-emitting region; and 6 an antistatic film. According to the studies of the present inventors et al., it has been found that even if the antistatic film 6 is formed as a high-resistance film, as shown by a path (current path) indicated by arrows in FIG. 22, a predetermined amount of current flowing through an area of the antistatic film 6 adjacent to the electroconductive thin film 4 exists and such a current amount largely influences a value of the leakage current. Although a detailed phenomenon is obscure, according to the consideration of the present inventors et al., it has been found that since the portion of the gap 5 of the electroconductive thin film 4 has an extremely high resistance, a voltage across the device electrodes 2 and 3 through the electroconductive thin film 4 is concentrated on the gap 5 (the electroconductive thin film 4 of the left side in the case where the gap 5 is used as a boundary has almost the same electric potential as that of the device electrode 2, the electroconductive thin film 4 of the right side has almost the same electric potential as that of the device electrode 3, and the gap 5 becomes the actual voltage applying portion), the antistatic film 6 of the area which is come into contact with the electroconductive thin film 4 near the gap 5 becomes a path (current path) whose resistance is lower than those of the other portions, and the leakage current is concentrated.

Since a similar current path also exists between the pair of device electrodes although an extent of the current path is smaller than that of the portion near the electron-emitting region, a measure against the leakage current is also necessary between the pair of device electrodes 2 and 3.

SUMMARY OF THE INVENTION

The invention is made in consideration of the foregoing conventional problems and it is an object of the invention to provide an electron source substrate which can suppress a leakage current flowing across device electrodes at the time of a low voltage in a non-driving mode, thereby decreasing a load of a driver IC in the case of using an image-forming apparatus, enabling the driver IC of a small capacity to be used, and enabling the costs of the image-forming apparatus to be decreased.

To accomplish the above object, according to the invention, there is provided an electron source substrate comprising: a substrate; an electron-emitting device having a pair of device electrodes locating on the substrate and an electroconductive thin film which is provided between the device electrodes and has a gap serving as an electron-emitting region; and an antistatic film which is in contact with at least the pair of device electrodes and covers over an exposed surface of the substrate, wherein a high-impedance portion which obstructs a current caused between the pair of device electrodes through the antistatic film is formed on the antistatic film.

According to the invention, there is provided an image-forming apparatus in which an electron source substrate having a plurality of electron-emitting devices and X-directional wirings and Y-directional wirings which are connected to each of the electron-emitting devices and formed in crossing directions and a substrate having an image-forming member for displaying an image by irradiation of an electron beam from the electron source substrate are arranged so as to face each other.

DETAILED DESCRIPTION OF THE PREFERRED EMBODIMENTS

The invention will be further explained hereinbelow.

Figure 1:
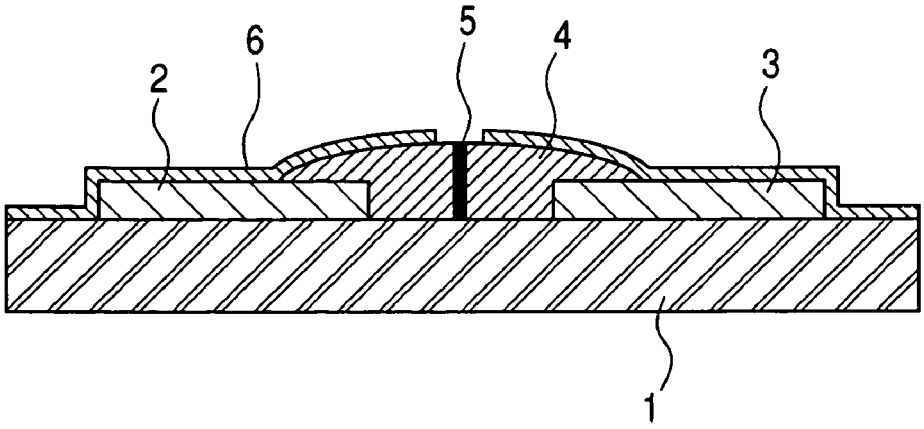
FIG. 1 is a schematic cross sectional view showing a fundamental construction regarding one electron-emitting device in an electron source substrate according to the invention.
Figure 2:
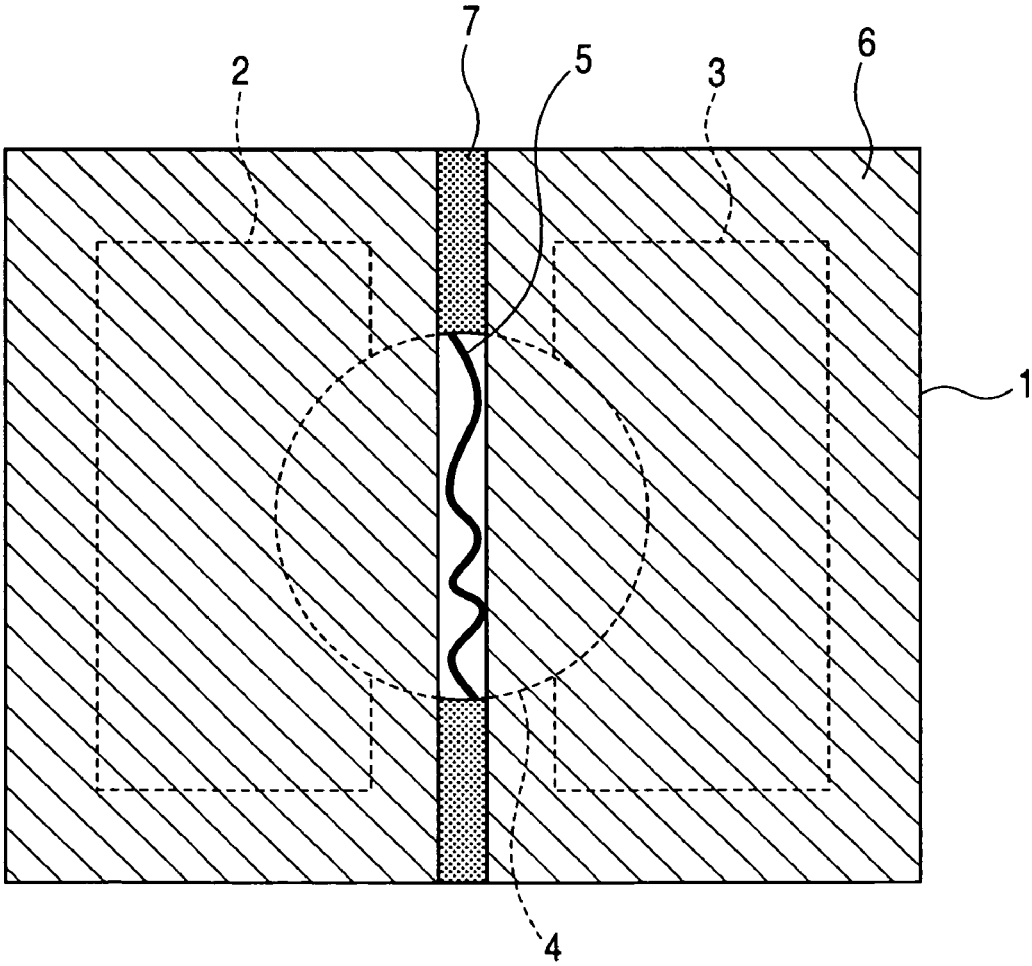
FIG. 2 is a schematic plan view showing a fundamental construction regarding one electron-emitting device in an electron source substrate according to the invention.

FIGS. 1 and 2 are schematic diagrams showing a fundamental construction regarding one electron-emitting device in an electron source substrate according to the invention. FIG. 1 is a cross sectional view. FIG. 2 is a plan view. In the diagrams, reference numeral 1 denotes the substrate; 2 and 3 the pair of device electrodes; 4 the electroconductive thin film; 5 the electron-emitting region; 6 the antistatic film; and 7 a high-impedance portion (refer to FIG. 2) formed in the antistatic film 6.

The substrate 1 is made of an insulative material such as glass or the like. It is preferable that the substrate 1 is made of a material in which a silicon oxide film having a thickness of about 0.5 μm has been formed as a sodium block layer onto glass such as soda lime glass or the like containing a small quantity of sodium, a quartz plate, or the like so as not to exert an adverse influence on electron-emitting characteristics of the electron-emitting device constructed by the pair of device electrodes 2 and 3 and the electroconductive thin film 4 having the electron-emitting region 5.

A general conductive material can be used as a material of the device electrodes 2 and 3. For example, it is possible to properly select one of a metal such as Ni, Cr, Au, Mo, Pt, Ti, or the like, an alloy such as Pd—Ag or the like, a print conductor made of a metal, glass, and the like, a transparent conductor such as ITO or the like, etc. A film thickness of each of the device electrodes is preferably set to a value within a range from hundreds of A° to a few μm.

An interval between the device electrodes 2 and 3, a length of each of the device electrodes 2 and 3, a shape of each of the device electrodes 2 and 3, and the like are properly designed in accordance with an application of the electron source substrate or the like. Generally, the interval between the device electrodes 2 and 3 is set to 1 to 100 μm and the length of each of the device electrodes 2 and 3 is set to a few to hundreds of μm.

As a method of forming the device electrodes 2 and 3, a general film forming method such as sputtering or the like, patterning by a photolithography, a printing method such as offset printing, or the like can be used.

To obtain good electron source characteristics, it is particularly preferable that the electroconductive thin film 4 is a fine-grained film made of minute particles and its film thickness is preferably set to 1 to 50 nm although it is properly selected in accordance with step coverage to the gap between the device electrodes 2 and 3, a resistance value, forming conditions, which will be explained hereinafter, and the like.

In the state before the forming (state before the electron-emitting region 5 is formed), which will be explained hereinafter, it is preferable that the resistance value of the electroconductive thin film 4 has a certain value enough to enable the forming step to be easily executed. Specifically speaking, it is desirable that the resistance value lies within a range from $10^3$ to $10^7$ Ω/□. On the contrary, it is preferable that the electroconductive thin film 4 after the forming (after the electron-emitting region 5 was formed) has a low resistance value so that a sufficient voltage can be applied to the electron-emitting region 5 through the device electrodes 2 and 3. Therefore, it is desirable that the electroconductive thin film 4 is formed as a thin film of metal oxide having a sheet resistance value below $10^3$ to $10^7$ Ω/□, it is deoxidized after the forming process, and a metal thin film of a lower resistance is formed. Therefore, a lower limit of the resistance value of the electroconductive thin film 4 in the final state is not particularly limited. The resistance value of the electroconductive thin film 4 mentioned here denotes a sheet resistance value which is measured in an area which does not include the electron-emitting region 5.

As a material of the electroconductive thin film 4, there can be given: a metal such as Pd, Pt, Ru, Ag, Au, or the like; an oxide such as PdO, $SnO_2$, $In_2O_3$, or the like; a boride such as $HfB_2$ or the like; a carbide such as TiC, SiC, or the like; a nitride such as TiN or the like; a semiconductor such as Si, Ge, or the like; carbon; or the like. As a forming method, it is possible to use an arbitrary one of various methods such as ink jet coating method, spin-coating method, dipping method, vacuum evaporation depositing method, sputtering method, and the like.

As a component material of the antistatic film 6, it is possible to preferably use a carbon material, metal oxide such as tin oxide, chromium oxide, antimony oxide, ITO, or the like, a material in which a conductive material has been dispersed into silicon oxide or the like, etc. It is preferable that a resistance value of the antistatic film 6 is a sheet resistance value below about $10^{12}$ Ω/□ to prevent the discharge and it is also desirable to control it to a resistance above $1\times10^9$ Ω/□ from a viewpoint of suppressing a leakage current. A film thickness of the antistatic film 6 is determined in accordance with a desired resistance value and, generally, is preferably set to 1 to 100 nm. As a forming method of the antistatic film 6, a sputtering method, a vacuum evaporation depositing method, a dipping method, a spray-coating method, a spin-coating method, a polymerizing method by an electron beam using carbon gases, a plasma polymerizing method, a CVD method, or the like can be given.

Although the antistatic film 6 shown in the diagrams has been formed on the device electrodes 2 and 3 and the electroconductive thin film 4, it can be also patterned and formed so as to selectively cover an exposed surface of the substrate 1 in the state where it is come into contact with at least the device electrodes 2 and 3 and the electroconductive thin film 4.

The high-impedance portion 7 obstructs a current caused across the pair of device electrodes 2 and 3 through the antistatic film 6 and is provided in a position where the antistatic film 6 is separated into a region which is continuous with the device electrode 2 and a region which is continuous with the device electrode 3. It is desirable that the high-impedance portion 7 has a sheet resistance value which is 100 or more times as large as that of the antistatic film 6 adjacent to the high-impedance portion 7 so that the current can be obstructed. Specifically speaking, it is desirable to have a sheet resistance value larger than $10^{12}$ Ω/□.

The high-impedance portion 7 can be formed as a thin film portion or a discontinuous portion of the antistatic film 6 by the following method. For example, the antistatic film 6 is not formed on the whole exposed surface of the substrate 1 but formed while leaving the gap (discontinuous portion), thereby partially and separately forming the antistatic film 6 of the device electrode 2 side and the antistatic film 6 of the device electrode 3 side, or after the antistatic film 6 is formed at least on the whole exposed surface of the substrate 1, the thin film portion or the discontinuous portion is formed between the antistatic film 6 of the device electrode 2 side and the antistatic film 6 of the device electrode 3 side, for example, by irradiation of a laser beam, or the like. The forming method of the high-impedance portion 7 will be described in detail in the embodiments.

The forming step of forming the electron-emitting region 5 into the electroconductive thin film 4 will now be described.

Figure 3A:
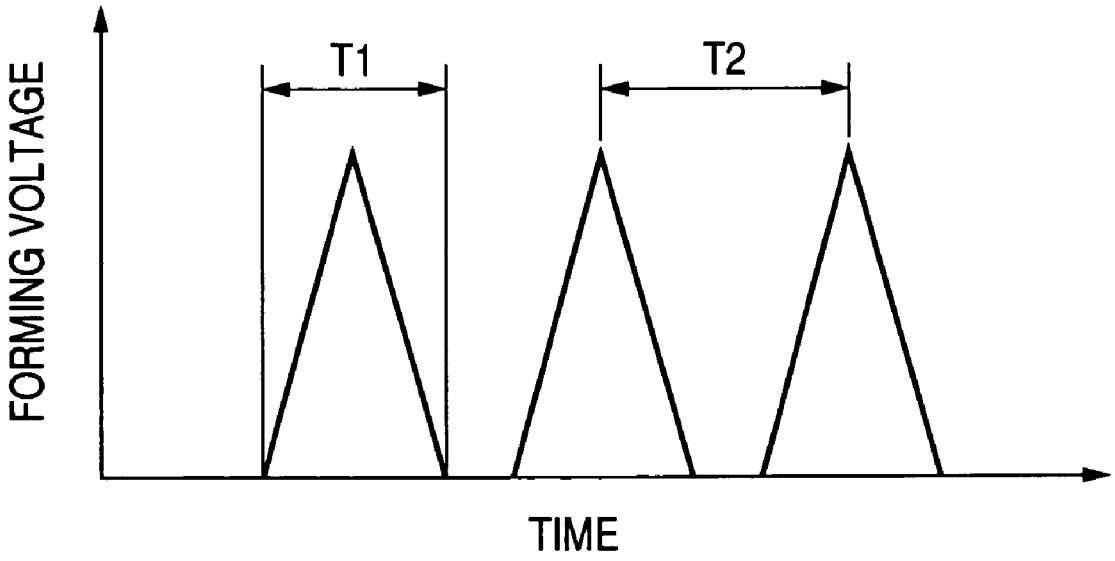
FIGS. 3A and 3B are diagrams showing examples of a waveform of an applied voltage which is used for forming.
Figure 3B:
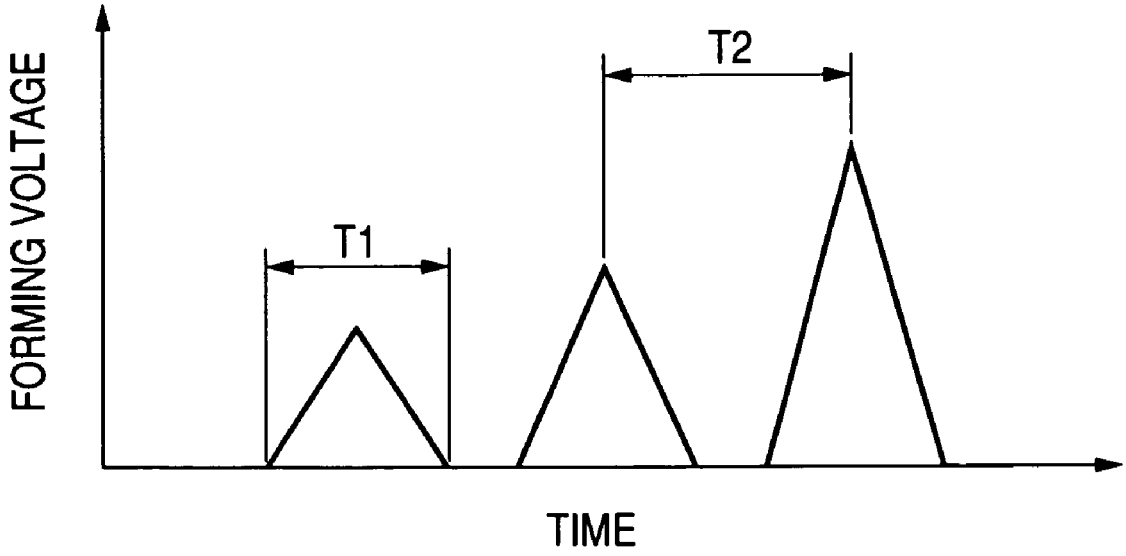

In the forming step, by applying a voltage from an external power source under a vacuum atmosphere and supplying a current across the device electrodes 2 and 3, the electroconductive thin film 4 is locally destroyed, deformed, or altered, thereby forming the gap-shaped electron-emitting region 5 in the electrically high-resistance state. Generally, a pulse waveform is used as a voltage which is applied and there are a case of applying pulses whose pulse peak values are set to a predetermined voltage as shown in FIG. 3A and a case of applying pulses while increasing the pulse peak value as shown in FIG. 3B. Ordinarily, a pulse width T1 in FIG. 3A is set to about 1 μsec to 10 msec, a pulse interval T2 is set to about 10 μsec to 100 msec, and a peak value (peak voltage upon forming) is properly selected in accordance with the material of the electroconductive thin film 4 or the like. In FIG. 3B, a pulse width T1 and a pulse interval T2 are equal to those in FIG. 3A and a peak value and an increase amount of the peak value are properly selected in accordance with the material of the electroconductive thin film 4 or the like.

In the case of using the metal oxide as an electroconductive thin film 4, by energizing and heating it under an atmosphere containing a small quantity of gas such as hydrogen or the like having reducing performance, the electron-emitting region 5 can be formed while reducing the electroconductive thin film 4. The electroconductive thin film 4 which was initially made of the metal oxide as a main component becomes the electroconductive thin film 4 made of the metal as a main component after the forming process, so that the resistance at the time of driving the electron-emitting device can be reduced. A step of perfectly reducing the electroconductive thin film 4 can be also added.

The forming process can be finished at the following timing. That is, a voltage of a level which does not locally destroy or deform the electroconductive thin film 4, that is, a pulse voltage of, for example, about 0.1V is applied between the pulses for forming, a device current is measured, a resistance value is obtained, and when a resistance which is 1000 or more times as large as that before the forming process is shown, the forming process is finished.

As will be explained hereinafter, in the case of executing the additional forming to form a fissure into the antistatic film, this means that the forming of an energy higher than that in the above forming step is further executed after the resistance value which is 1000 or more times as large as that of the electroconductive thin film 4 before the forming process is shown as mentioned above.

An activating step wherein a film (not shown in FIGS. 1 and 2) made of carbon and/or a carbon compound as a main component is arranged in the electron-emitting region 5 formed by the forming step and on its peripheral electroconductive thin film 4 will now be described.

The activating step is executed, for example, by introducing a gas of a proper carbon compound into the vacuum and applying a pulse voltage across the device electrodes 2 and 3. By executing the activating step, an emission current emitted from a portion near the electron-emitting region 5 can be fairly increased.

Since a preferable gas pressure of the carbon compound in the activating step differs depending on the application of the electron source substrate, a kind of carbon compound, or the like, it is properly set in accordance with circumstances.

As a proper carbon compound, there can be given: an aliphatic hydrocarbon class of alkane, alkene, or alkyne; an aromatic hydrocarbon class; an alcohol class; an aldehyde class; a ketone class; an amine class; an organic acid class of phenol, carvone, sulfone, or the like; etc. For example, in the case of trinitrile, a pressure of the carbon compound which is introduced is preferably set to about $1\times10^{-5}$ to $1\times10^{-2}$ Pa although it is slightly influenced by a shape of a vacuum apparatus, members used for the vacuum apparatus, a kind of carbon compound, and the like.

By executing the process for applying the pulse voltage across the device electrodes 2 and 3 in the state where the carbon compound exists, the film made of the carbon and/or the carbon compound is formed from the carbon compound existing in the atmosphere into the electron-emitting region 5 formed by the forming step and on its peripheral electroconductive thin film 4.

Figure 4A:
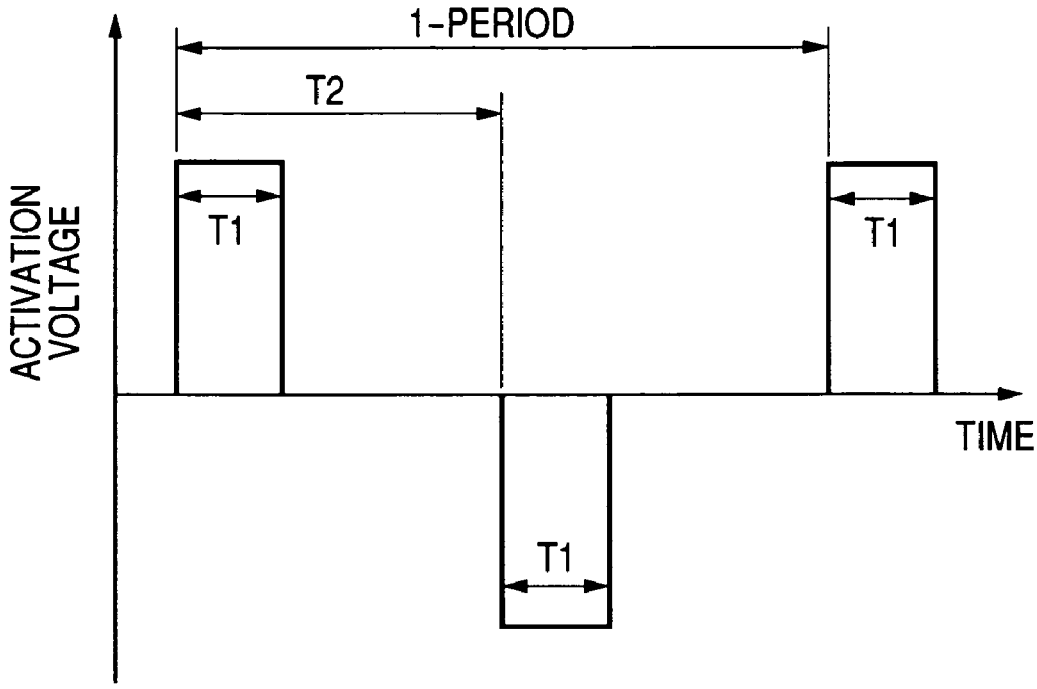
FIGS. 4A and 4B are diagrams showing examples of a waveform of an applied voltage which is used for activation.
Figure 4B:
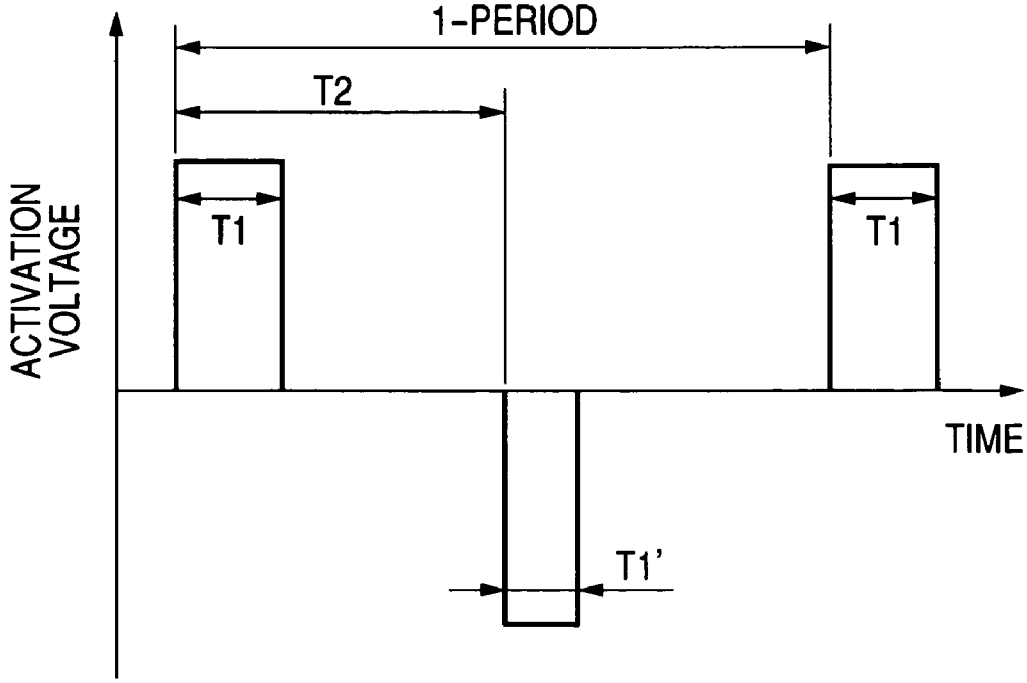

FIGS. 4A and 4B show preferable examples of the waveform of the applied voltage which is used in the activating step. Generally, the maximum value of the voltage which is applied is properly selected from a range of 10 to 20 V. In FIG. 4A, T1 denotes the positive and negative pulse widths of the voltage waveform, T2 indicates the pulse interval, and the positive and negative absolute values of the voltage value are set to an equal value. In FIG. 4B, T1 and T1' denote the positive and negative pulse widths of the voltage waveform, T2 indicates the pulse interval, T1>T1', and the positive and negative absolute values of the voltage value are set to an equal value.

The activating step is executed while measuring the device current or emission current and it can be finished when the device current or emission current is set to a desired value. The pulse width, pulse interval, pulse peak value, and the like of the pulse voltage which is applied are also properly set in accordance with the kind of carbon compound, its gas pressure, and the like.

A constructional example of the electron source substrate as mentioned above, that is, the electron source substrate having a plurality of electron-emitting devices and an image-forming apparatus for displaying an image by using such an electron source substrate will now be described with reference to FIGS. 5 and 6.

Figure 5:
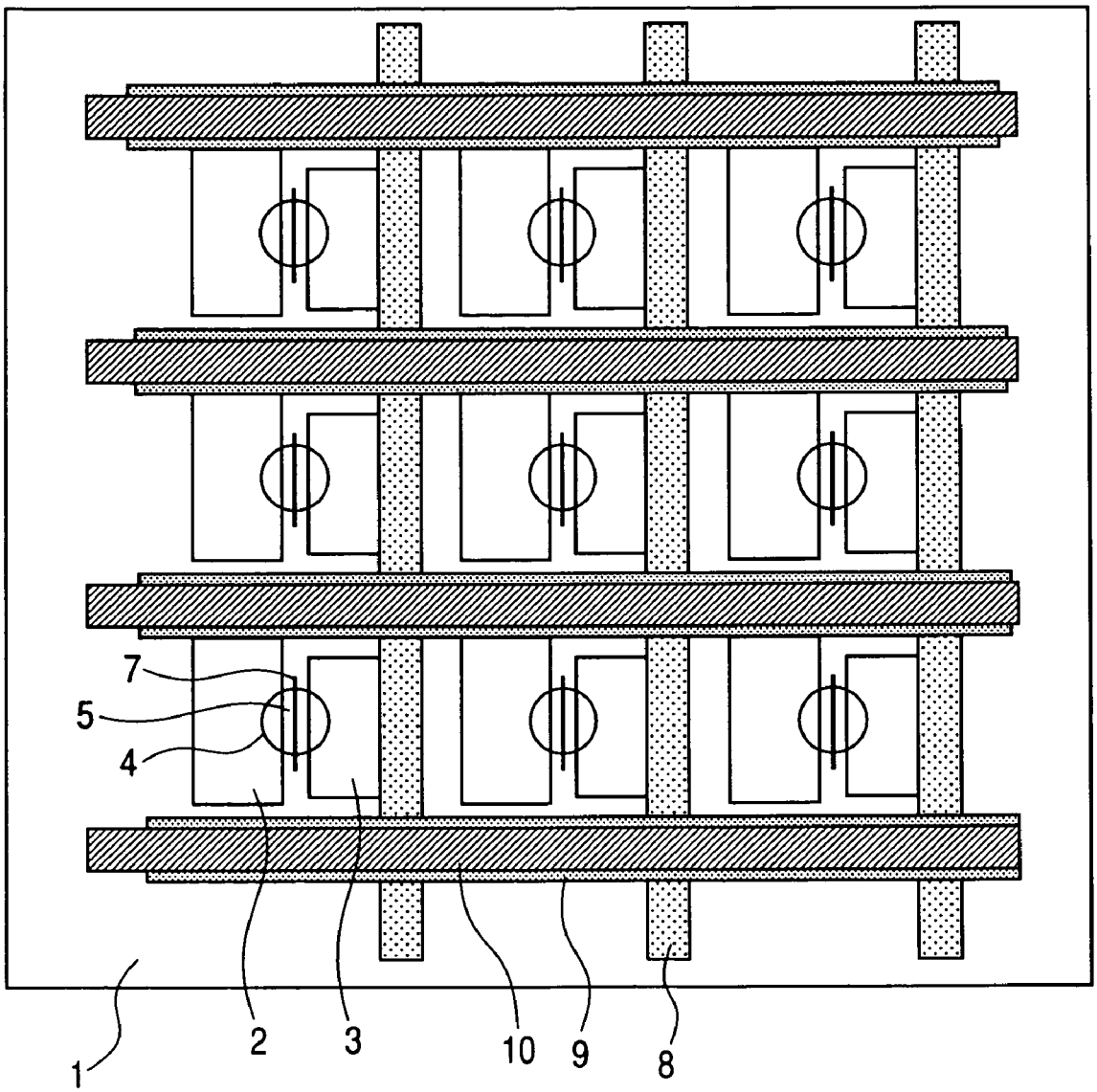
FIG. 5 is a schematic plan view of an electron source substrate having a plurality of electron-emitting devices (an antistatic film is omitted here)

FIG. 5 is a schematic plan view of the electron source substrate having a plurality of electron-emitting devices (the antistatic film 6 is omitted here). FIG. 6 is a perspective view of the image-forming apparatus using such an electron source substrate with a part cut away. The same component elements as those in FIGS. 1 and 2 are designated by the same reference numerals.

As shown in FIG. 5, in the electron source substrate, a plurality of pairs of device electrodes 2 and 3 are formed onto the substrate 1 and the electroconductive thin film 4 having the electron-emitting region 5 is formed over each pair of device electrodes 2 and 3. The high-impedance portion 7 is formed in the antistatic film 6 in the position where a leakage current flowing across each pair of device electrodes 2 and 3 through the antistatic film 6 can be suppressed.

Y-directional wirings (lower wirings) 8 connected to the device electrodes 3 are formed on the substrate 1. X-directional wirings (upper wirings) 10 connected to the other device electrodes 2 are further formed over the substrate 1 through insulative layers 9 in the direction which crosses the Y-directional wirings 8. With respect to the Y-directional wirings 8 and the X-directional wirings 10, it is required that their resistances are low so that an almost equal voltage is supplied to the electron-emitting devices and their materials, film thicknesses, wiring widths, and the like are properly set. As an example of a forming method of the Y-directional wirings 8, the X-directional wirings 10, and the insulative layer 9, a combination of a printing method or a sputtering method and a photolithography technique, or the like can be used. Each electron-emitting device can be selectively driven by applying the voltage across the device electrodes 2 and 3 through the Y-directional wirings 8 and the X-directional wirings 10.

Figure 6:
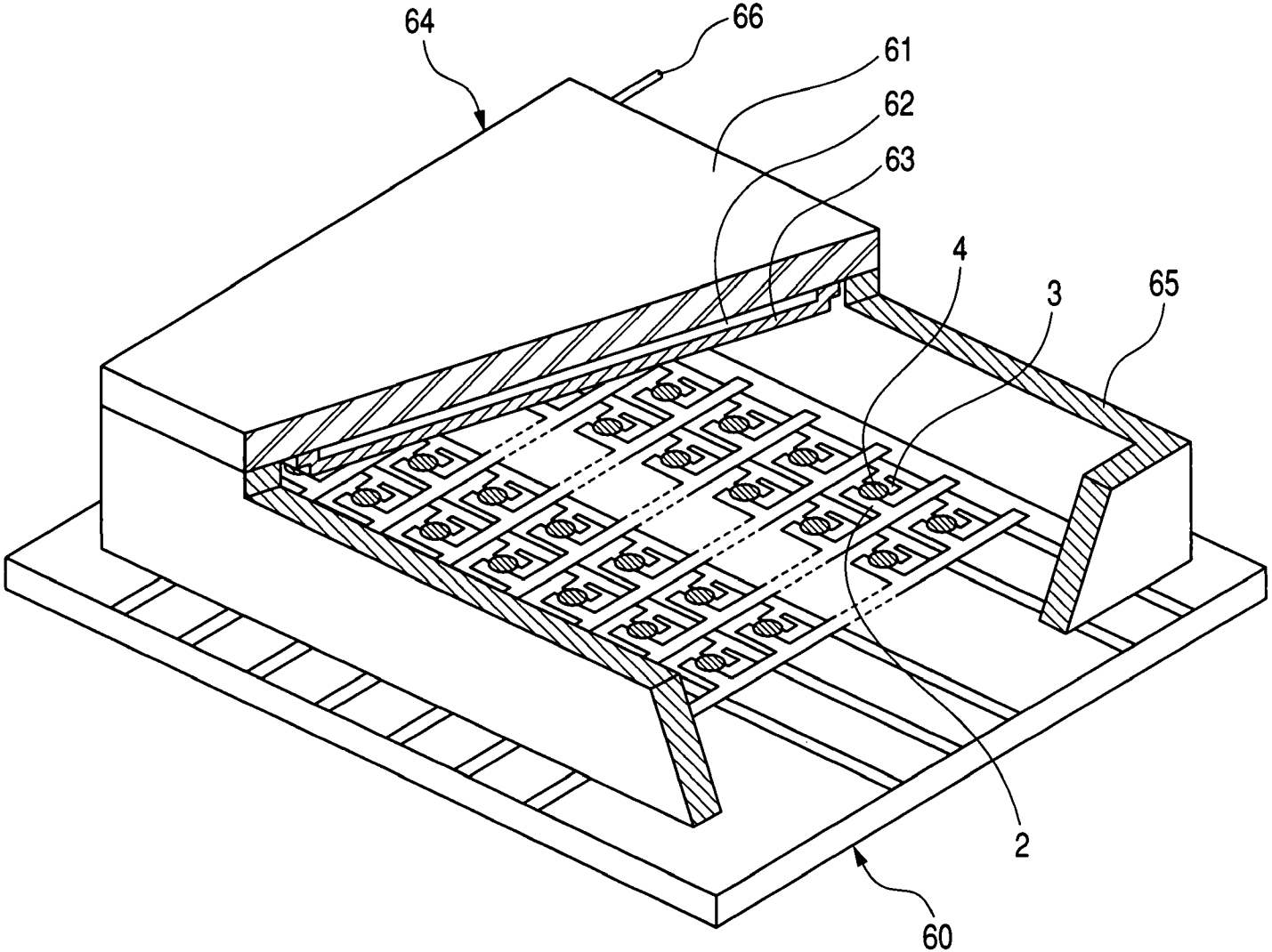
FIG. 6 is a schematic perspective view of an image-forming apparatus using the electron source substrate shown in FIG. 5 with a part cut away.

In the image-forming apparatus shown in FIG. 6, the electron source substrate shown in FIG. 5 is arranged as a rear plate 60. A face plate 64 obtained by forming a phosphor film 62, a metal back 63, and the like onto the inner surface of a transparent insulative substrate 61 such as glass or the like is provided so as to face the rear plate 60. Reference numeral 65 denotes a supporting frame. The rear plate 60, the supporting frame 65, and the face plate 64 are seal-bonded with frit glass or the like and construct a panel-shaped chest.

A space surrounded by the rear plate 60, the supporting frame 65, and the face plate 64 becomes a vacuum atmosphere. The vacuum atmosphere can be formed by providing an exhaust pipe for the rear plate 60 or the face plate 64, vacuum-exhausting the inside, and thereafter, sealing the exhaust pipe. However, if the seal-bonding of the rear plate 60 and the face plate 64 which is executed through the supporting frame 65 is performed in a vacuum chamber, the vacuum atmosphere can be easily formed.

The image can be displayed by the following method. A driving circuit to drive the electron-emitting devices is connected to the image-forming apparatus, the voltage is applied across the desired device electrodes 2 and 3 through the Y-directional wirings 8 and the X-directional wirings 10 to thereby allow electrons to be emitted from the electron-emitting region 5 (refer to FIGS. 1 to 3A and 3B), and a high voltage is applied to the metal back 63 as an anode electrode from a high-voltage terminal 66, thereby accelerating an electron beam and allowing the beam to collide with the phosphor film 62.

By arranging a supporting member (not shown) called a spacer between the face plate 64 and the rear plate 60, a panel-shaped chest of a large area having a sufficient strength against the atmospheric pressure can be constructed.

The electron-emitting device in which the electroconductive thin film 4 having the electron-emitting region 5 (refer to FIGS. 3A and 3B) over the pair of device electrodes 2 and 3 is called a surface conduction electron-emitting device. According to fundamental characteristics of the surface conduction electron-emitting device, in the case where the voltage is equal to or higher than a threshold voltage, the emission electrons from the electron-emitting region (electron-emitting region 5) are controlled by the peak value and the width of the pulse-shaped voltage which is applied across the device electrodes 2 and 3 which face each other and the current amount is also controlled by its intermediate value. Therefore, a halftone display can be performed. In the case where a number of electron-emitting devices are arranged as in the embodiment, if the lines to be selected are decided by a scanning line signal of each line and the pulse-shaped voltage is properly applied to each electron-emitting device through each information signal line, the voltage can be applied to arbitrary electron-emitting devices and the arbitrary electron-emitting devices can be turned on.

The construction of the image-forming apparatus mentioned above is shown as an example of the image-forming apparatus of the invention and various modifications are possible on the basis of the technical idea of the invention.

Figure 7:
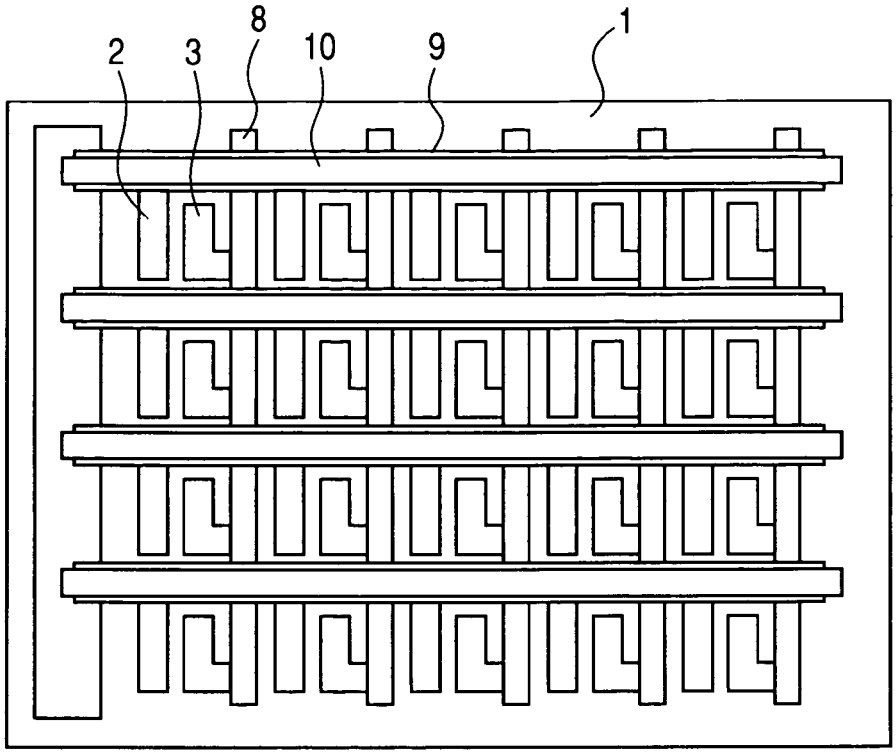
FIG. 7 is a schematic plan view showing the state before an electroconductive thin film is formed during a manufacturing step of the electron source substrate having a plurality of electron-emitting devices.
Figure 8:
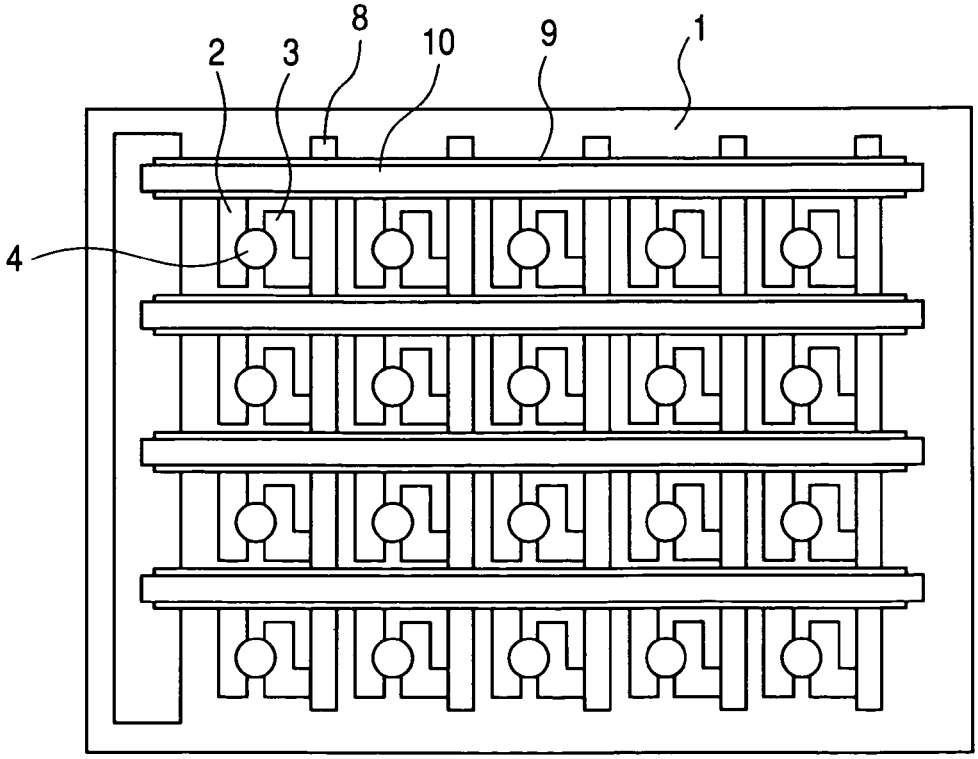
FIG. 8 is a schematic plan view showing the state before the forming during a manufacturing step of the electron source substrate having a plurality of electron-emitting devices.

First, the processes until the electroconductive thin film 4 is formed after the device electrodes 2 and 3 were formed will be described with reference to FIGS. 7 and 8. FIG. 7 is a schematic plan view showing the state before the electroconductive thin film 4 is formed during a manufacturing step of the electron source substrate having a plurality of electron-emitting devices. FIG. 8 is a schematic plan view showing the state before the forming during a manufacturing step of the electron source substrate having a plurality of electron-emitting devices.

(Creation of the Device Electrodes)

As a substrate 1 in FIG. 7, glass having a thickness of 2.8 mm of "PD200" (made by Asahi Glass Co., Ltd.) in which a quantity of alkali components is small is used, the upper surface of this glass is further coated with an $SiO_2$ film having a thickness of 100 nm as a sodium block layer, the resultant glass is baked, and the obtained glass is used.

The device electrodes 2 which are in contact with the X-directional wirings (upper wirings) 10 and the device electrodes 3 which are in contact with the Y-directional wirings (lower wirings) 8 are formed by the following method. That is, first, a titanium (Ti) film having a thickness of 5 nm is formed as an underlayer onto the substrate 1 by the sputtering method, a platinum (Pt) film having a thickness of 40 nm is formed thereon, and thereafter, the resultant surface is coated with a photo resist and patterned by a series of photolithography method such as exposure, development, and etching, thereby forming those electrodes.

(Creation of the Y-Directional Wirings)

The Y-directional wirings 8 which are used as common wirings are formed by a method whereby a silver (Ag) paste made by Noritake Co., Ltd. is used as a material and printed by the screen printing method in the state where it is come into contact with the device electrodes 3, and thereafter, it is baked at 580° C. for 8 minutes. As shapes of the Y-directional wirings 8, they are formed by a line-shaped pattern so as to couple a plurality of device electrodes 3. A thickness of each of the Y-directional wirings 8 is set to about 10 μm and a line width is set to 50 μm.

(Creation of the Insulative Layer)

Subsequently, the insulative layer 9 is formed to insulate the Y-directional wirings 8 and the X-directional wirings 10 provided in the direction which crosses the wirings 8. The insulative layer 9 is formed by the following method. That is, a paste in which PdO is used as a main component and a glass binder is mixed is used as a component material, printed by the screen printing method, and baked at 580° C. for 8 minutes, and by repeating these processing steps twice, the insulative layer 9 is formed. A thickness of insulative layer 9 is set to about 30 μm and a line width is set to 150 μm. Contact holes are formed in the insulative layer 9 in the positions serving as connecting portions of the X-directional wirings 10 and the device electrodes 2 so that they can be electrically connected.

(Creation of the X-Directional Wirings)

The X-directional wirings 10 are formed after the insulative layer 9 was formed. The X-directional wirings 10 are formed by a method whereby a silver (Ag) paste is printed onto the formed insulative layer 9 by the screen printing method, and baked at 480° C. for 10 minutes. The X-directional wirings 10 are connected to the device electrodes 2 in the contact hole portions of the insulative layer 9. The X-directional wirings 10 are formed in a line-shape in the direction which crosses the Y-directional wirings 8 and a thickness of each of the X-directional wirings 10 is set to about 15 μm.

Although not shown, leading terminals to the external driving circuit are also formed by a method similar to that mentioned above.

(Creation of the Electroconductive Thin Film)

The electroconductive thin film 4 is formed between the device electrodes 2 and 3 by the ink-jet coating method, so that the substrate 1 before the creation of the electron-emitting region 5 (refer to FIGS. 1, 2, and 5) by the forming is obtained as shown in FIG. 8.

Upon ink-jet coating, to compensate a planer variation of each of the device electrodes 2 and 3 on the substrate 1, a layout deviation of the pattern is observed at several points on the substrate 1, a deviation amount of the points between the observing points is linearly approximated to thereby complement the position, thereby eliminating the positional deviation of all pixels and allowing the coating process to be accurately performed to the corresponding positions.

As a coating material, to obtain the electroconductive thin film 4 of a palladium film, first, a small amount of additive agent is added and a palladium complex is dissolved into a solvent comprising water and isopropyl alcohol (IPA), so that a solution containing palladium is obtained. A droplet of such a solution is adjusted so as to have a dot diameter of 60 μm and injected between the device electrodes 2 and 3 on the substrate 1 by an ink-jet injecting apparatus using piezoelectric elements as droplet applying means. After that, the substrate 1 is heated and baked in the air at 350° C. for 10 minutes, thereby forming a thin film of palladium oxide (PdO). A diameter of PdO thin film is equal to about 60 μm and a maximum thickness is equal to 10 nm.

Embodiment 1

With respect to the substrate 1 shown in FIG. 8 obtained until the electroconductive thin film 4 is formed after the device electrodes 2 and 3 were formed as mentioned above, the creation, forming, and activation of the antistatic film 6, which will be. explained hereinbelow, are executed and characteristics are evaluated.

(Creation of the Antistatic Film)

Figure 9:
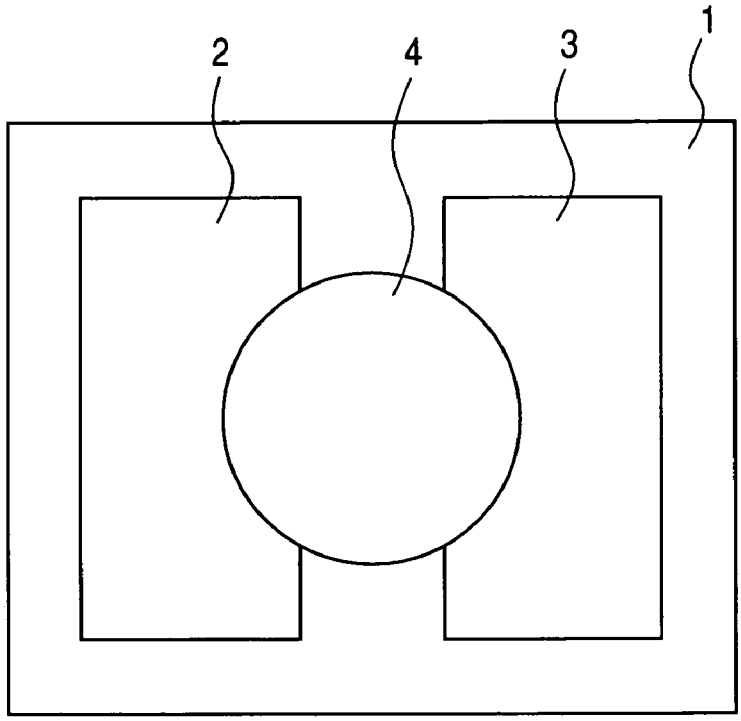
FIG. 9 is an explanatory diagram of a step of forming a high-impedance portion in the electron source substrate according to the embodiment 1 and is a schematic plan view showing a fundamental construction regarding a pair of device electrodes on the substrate of FIG. 8 which is obtained until an electroconductive thin film is formed after the device electrodes were formed.
Figure 10:
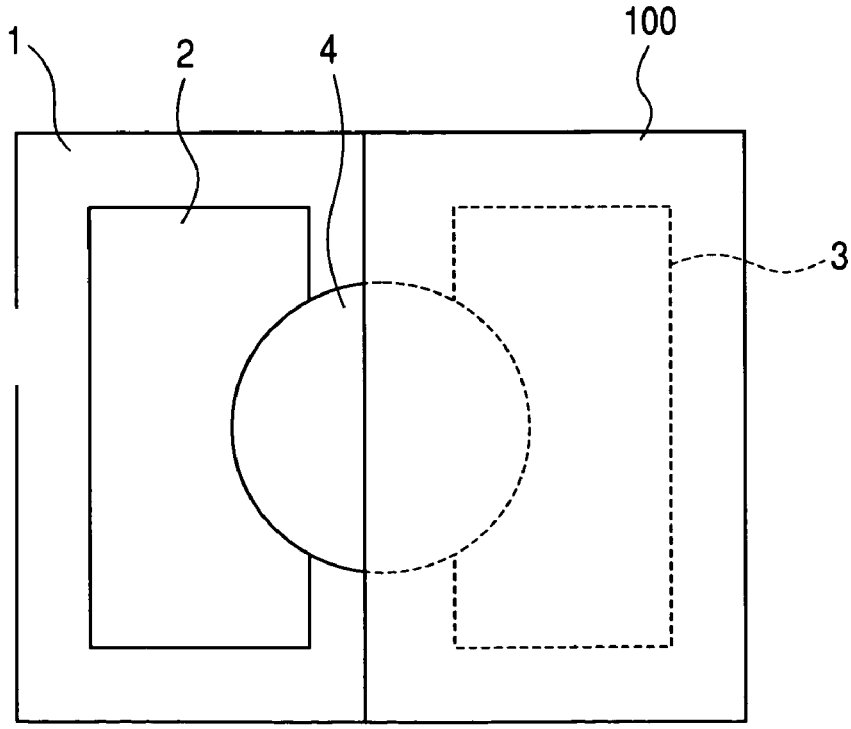
FIG. 10 is an explanatory diagram of the step of forming the high-impedance portion in the electron source substrate according to the embodiment 1 and is a schematic plan view showing the state where a resist film has been formed on the substrate of FIG. 9.

FIG. 9 is a schematic plan view showing a fundamental construction regarding the pair of device electrodes 2 and 3 on the substrate 1 shown in FIG. 8 which is obtained until the electroconductive thin film 4 is formed after the device electrodes 2 and 3 were formed as mentioned above. The whole surface of the substrate 1 in the state of FIG. 9 is coated with a photosensitive resist liquid. As shown in FIG. 10, the electroconductive thin film 4 is divided into almost halves and patterned so that a resist film 100 remains only on the side of one of the device electrodes 2 and 3 (device electrode 3 side in FIG. 10). The coating step of the resist liquid can be executed by the spinner method, dipping method, spray-coating method, or the like which is ordinarily used.

Figure 11:
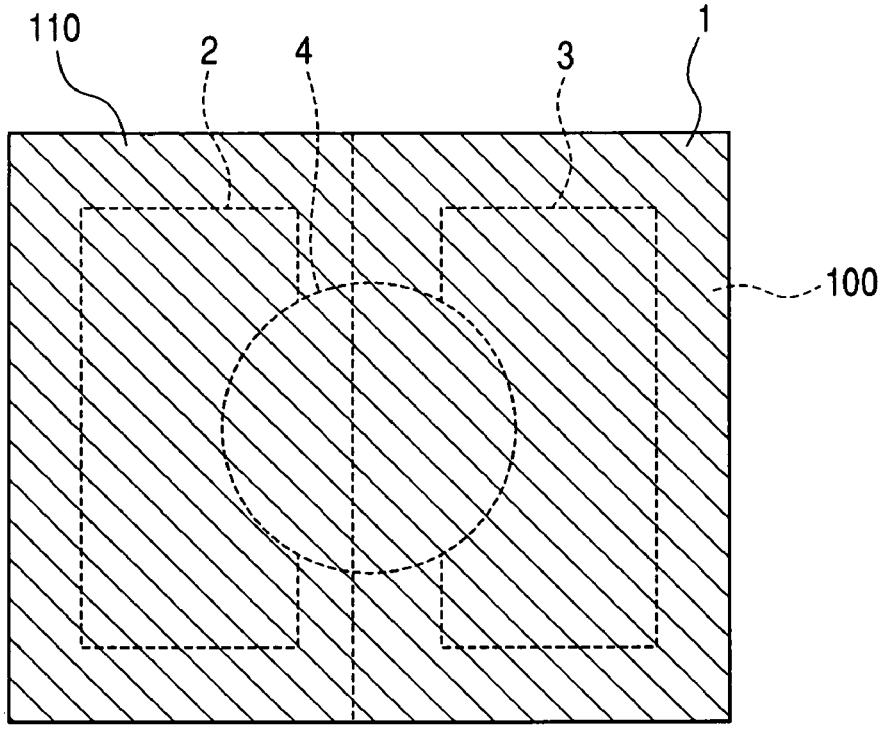
FIG. 11 is an explanatory diagram of the step of forming the high-impedance portion in the electron source substrate according to the embodiment 1 and is a schematic plan view showing the state where an antistatic film has been formed on the substrate of FIG. 10.

Subsequently, the whole surface of the substrate 1 is coated with a coating liquid containing the component material of the antistatic film 6 (refer to FIGS. 1 and 2) from a position over the resist film 100. As a coating liquid, a dispersing liquid in which minute particles of tin oxide have been dispersed is used and the whole surface is uniformly coated with the dispersing liquid by the spray, thereby obtaining a state of FIG. 11 in which the surface of the substrate 1 is covered with a coating film 110.

Figure 12:
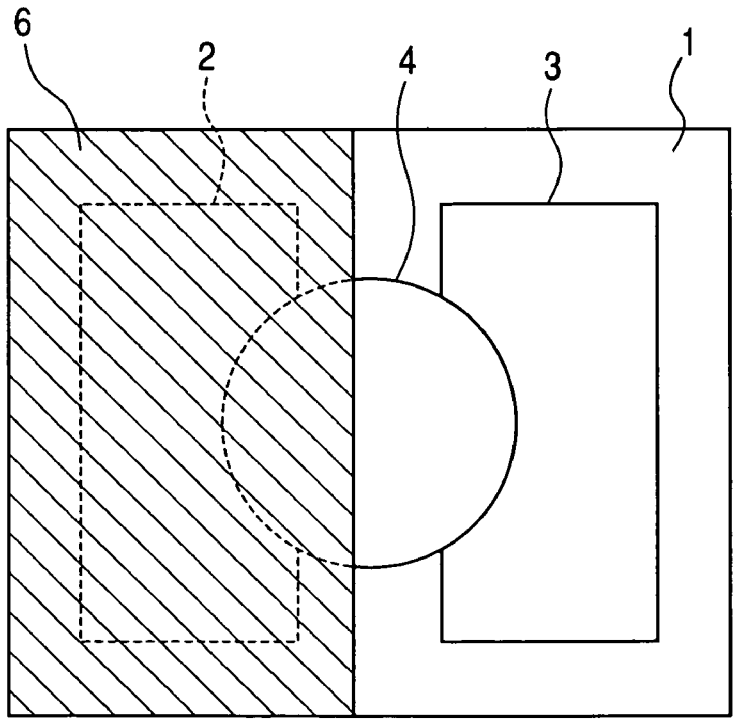
FIG. 12 is an explanatory diagram of the step of forming the high-impedance portion in the electron source substrate according to the embodiment 1 and is a schematic plan view showing the state where the resist film has been peeled off from the substrate of FIG. 11.

By peeling off the resist film 100 (refer to FIG. 10) by using a peeling liquid, the coating film 110 on the resist film 100 is removed and the resultant substrate is baked in an atmospheric baking furnace at 350 to 400° C. for about 10 to 30 minutes. As shown in FIG. 12, the electroconductive thin film 4 is divided into almost halves and the antistatic film 6 is formed only on the side of one of the device electrodes 2 and 3 (device electrode 2 side in FIG. 12).

Figure 13:
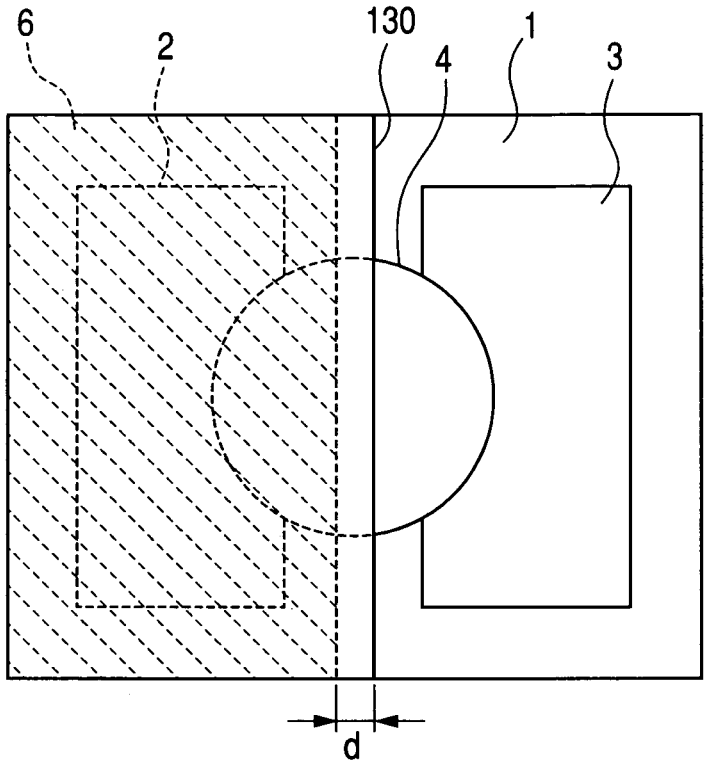
FIG. 13 is an explanatory diagram of the step of forming the high-impedance portion in the electron source substrate according to the embodiment 1 and is a schematic plan view showing the state where a resist film has been formed on the substrate of FIG. 12 again.

Subsequently, the whole surface of the substrate 1 is coated with the photosensitive resist liquid again and patterned so that a resist film 130 remains on the side of the antistatic film 6 which has already been formed as shown in FIG. 13. The resist film 130 is patterned so as to cover the antistatic film 6 and the device electrode 3 side is made to be larger than the antistatic film 6 by an interval (d).

Figure 14:
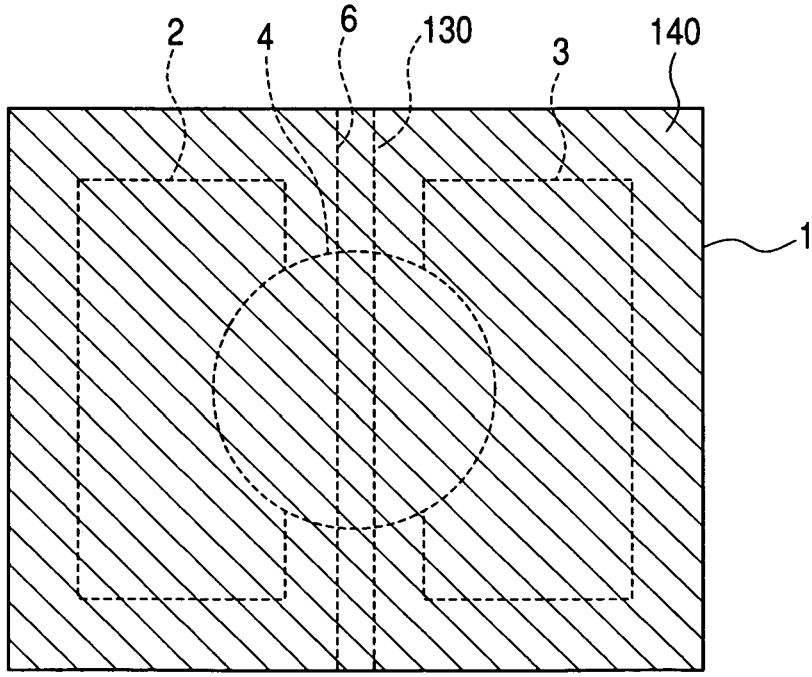
FIG. 14 is an explanatory diagram of the step of forming the high-impedance portion in the electron source substrate according to the embodiment 1 and is a schematic plan view showing the state where an antistatic film has been formed on the substrate of FIG. 13 again.

After the creation of the resist film 130, the whole surface of the substrate 1 is coated again with the same coating liquid as that mentioned above, thereby obtaining a state of FIG. 14 in which the surface of the substrate 1 is covered with a coating film 140.

Figure 15:
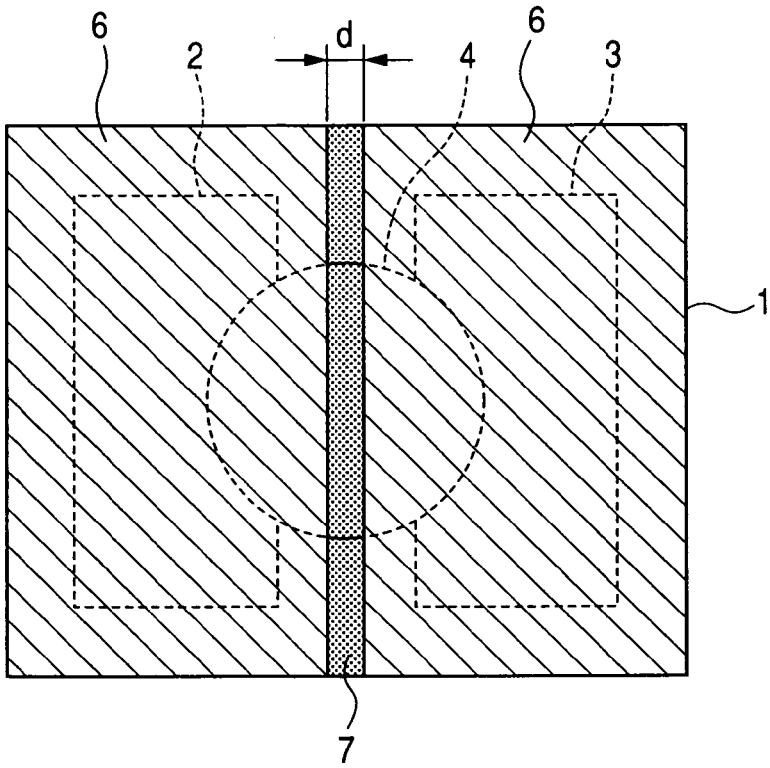
FIG. 15 is an explanatory diagram of the step of forming the high-impedance portion in the electron source substrate according to the embodiment 1 and is a schematic plan view showing the state where the resist film has been peeled off from the substrate of FIG. 14.

By peeling off the resist film 130 (refer to FIG. 13) by using the peeling liquid, the coating film 140 on the resist film 130 is removed, the resultant substrate is baked in the atmospheric baking furnace at 350 to 400° C. for about 10 to 30 minutes. As shown in FIG. 15, the antistatic films 6 and 6 which are separated to the device electrode 2 side and the device electrode 3 side by the high-impedance portion 7 as a discontinuous portion of the interval (d) passing through almost the center portion of the electroconductive thin film 4 are formed.

The discontinuous portion of the interval (d) at this time is set to about 2 to 3 μm in consideration of precision of a mask pattern. It has been confirmed by the following measurement that a sheet resistance of the high-impedance portion 7 (discontinuous portion) interposed between the separated antistatic films 6 and 6 is larger than $1\times10^{12}$ Ω/□.

(Forming)

Subsequently, the forming step is executed.

In the state where edge portions of the Y-directional wirings 8 and the X-directional wirings 10 are exposed as extraction electrodes around the substrate 1 shown in FIG. 7, a hood-shaped cap is put so as to cover the whole substrate 1 and the inner space between them is exhausted by a vacuum pump, thereby forming a vacuum space in the region between the substrate 1 and the cap. The inside is exhausted until an internal pressure reaches $2\times10^{-3}$ Pa. Further, nitrogen gases in which 2% hydrogen is mixed are introduced. The voltage is applied between the X-directional wirings 10 and the Y-directional wirings 8 from the extraction electrode portions by an external power source and a current is supplied between the device electrodes 2 and 3, so that the gap 5 in the electrically high-resistance state is formed in the electroconductive thin film 4. The forming voltage is set to the waveform shown in FIG. 3A. In the embodiment, the pulse width T1 is set to 0.1 msec, a pulse interval T2 is set to 10 msec, and the peak value is set to 10V.

(Activation)

The process called activation is subsequently executed.

In a manner similar to the foregoing forming process, a vacuum space is formed and the pulse voltage is repetitively applied to the device electrodes 2 and 3 from the outside through the X-directional wirings 10 and the Y-directional wirings 8.

In this step, trinitrile is used as a carbon source and introduced into the vacuum space between the hood-shaped cap and the substrate 1 through a slow leakage valve, and a pressure of $1.3\times10^{-4}$ Pa is maintained.

The voltage which is applied is set to a waveform as shown in FIG. 4A, the pulse width T1 is set to 1 msec, the pulse interval T2 is set to 10 msec, and the peak value is set to 16V.

The energization is stopped at a point when the device current reaches almost a saturation value after about 60 minutes, the slow leakage valve is closed, and the activating process is finished.

The electron source substrate having a plurality of electron-emitting devices as shown in FIG. 8 can be formed by the foregoing processing steps. In FIG. 8, the electron-emitting region 5, the antistatic film 6, and the high-impedance portion 7 are omitted and their explanation has been made above with reference to FIGS. 1, 2, and 5.

(Evaluation of Characteristics)

First, a measuring and evaluating apparatus of characteristics will be described with reference to FIG. 16.

Figure 16:
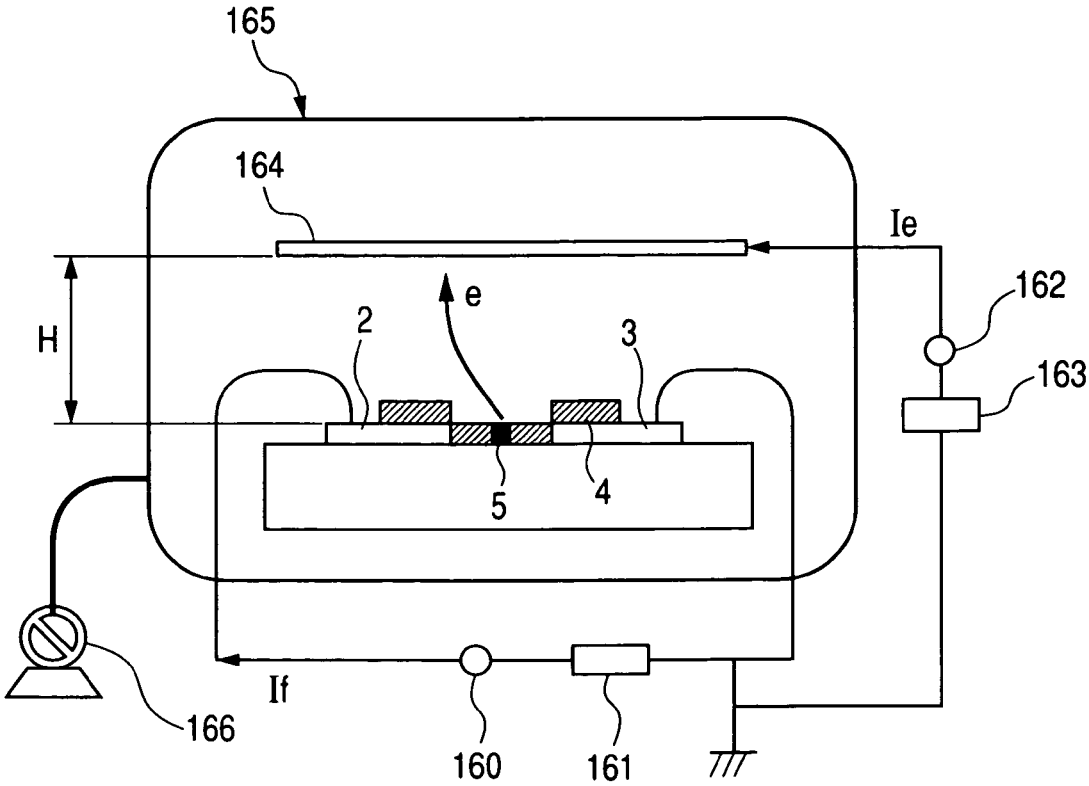
FIG. 16 is an explanatory diagram of a measuring and evaluating apparatus of characteristics of the electron source substrate.

FIG. 16 is an explanatory diagram of the measuring and evaluating apparatus for measuring the characteristics of the electron source substrate.

In the measuring and evaluating apparatus shown in FIG. 16, to measure a device current If flowing across the device electrodes 2 and 3 of the electron-emitting device and an emission current Ie to an anode electrode 164, a power source 161 and an ammeter 160 are connected to the device electrodes 2 and 3 and the anode electrode 164 to which a power source 163 and an ammeter 162 are connected is arranged over the electron-emitting device.

In FIG. 16, reference numeral 1 denotes the insulative substrate; 2 and 3 the device electrodes; 4 the electroconductive thin film; and 5 the electron-emitting region. Reference numeral 161 denotes the power source for applying a device voltage Vf to the electron-emitting device; 160 the ammeter to measure the device current If flowing in the electroconductive thin film 4 including the electron-emitting region 5 between the device electrodes 2 and 3; 164 the anode electrode to capture the emission current Ie which is emitted from the electron-emitting region 5 of the electron-emitting device; 163 the high-voltage power source to apply the voltage to the anode electrode 164; and 162 the ammeter to measure the emission current Ie which is emitted from the electron-emitting region 5 of the electron-emitting device. The electron-emitting device and the anode electrode 164 are disposed in a vacuum apparatus 165. Apparatuses such as exhaust pump 166, vacuum gauge, and the like which are necessary for the vacuum apparatus are provided for the vacuum apparatus, thereby enabling the electron-emitting device to be measured and evaluated in a desired vacuum. The voltage to the anode electrode 164 is set to 1 to 10 kV, a distance H between the anode electrode 164 and the electron-emitting device is set to a range from 2 to 8 mm, and the measurement is performed.

The characteristics of the electron source substrate formed in accordance with the embodiment 1 are measured and evaluated by using the measuring and evaluating apparatus.

The voltage which is applied between the device electrodes 2 and 3 is set to a standard voltage of 17V and the measurement is performed. A scanning line voltage on the side of the X-directional wirings 10 at that time is set to −11V and a signal line voltage on the side of the Y-directional wirings is set to +6V. The voltage which is applied between the anode electrode 164 and the electron source substrate is set to 1 kV and the measurement is performed. Thus, values of If=1 mA, Ie=1.2 μA, and efficiency=0.12% are obtained.

The voltage 6V is applied as a non-selection voltage to the electron-emitting devices which are not selected under the above conditions and non-selection currents of the number corresponding to the number of non-selection electron-emitting devices flow in a driving IC. In the electron source substrate according to the embodiment, however, a leakage current in the case where 6V upon non-selection has been applied is equal to or less than 0.1 μA and very weak.

Embodiment 2

In a manner similar to the embodiment 1, with respect to the substrate 1 shown in FIG. 8 and obtained until the electroconductive thin film 4 is formed after the device electrodes 2 and 3 were formed, the whole surface of the substrate 1 on which the device electrodes 2 and 3 and the like have been formed is coated with a coating liquid of an antistatic film similar to that in the embodiment 1 by a spray coating method similar to that in the embodiment 1 (however, the resist films 100 and 130 are not provided), baked in the atmospheric baking furnace at 350 to 400° C. for 10 to 30 minutes, thereby forming the antistatic film 6 (refer to FIGS. 1 and 2).

Figure 17:
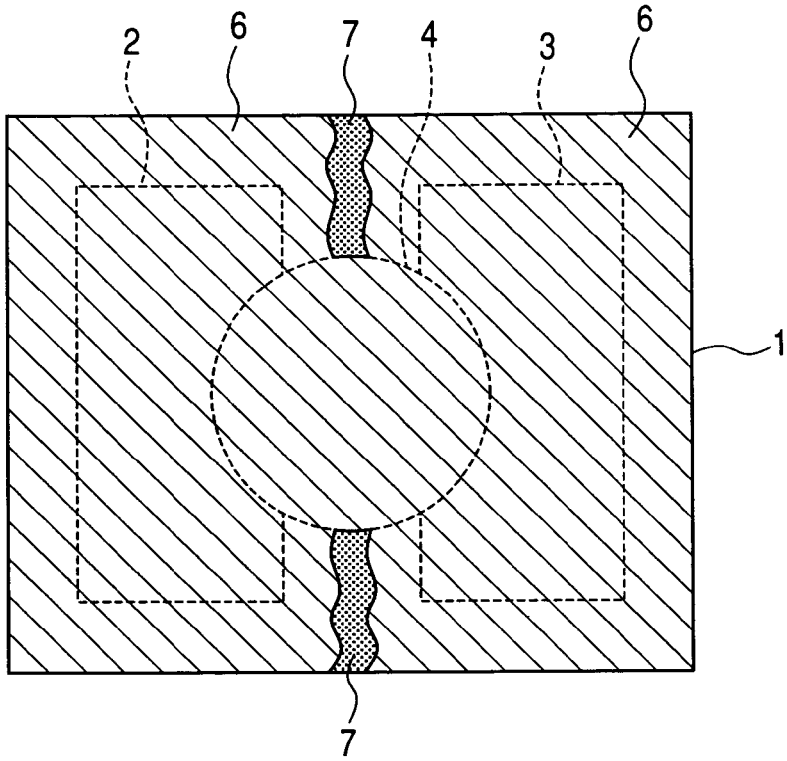
FIG. 17 is a schematic plan view showing a fundamental construction regarding one electron-emitting device in an electron source substrate according to the embodiment 2 in which a high-impedance portion has been formed by laser irradiation.

After that, the antistatic film 6 is separated by using a laser beam machine so as to have a width of 2 to 3 μm as shown in FIG. 17. An area of the first antistatic film 6 connected to the device electrode 2 and an area of the second antistatic film 6 connected to the device electrode 3 are separated through the high-impedance portion 7 as a separating portion. It has been confirmed by the subsequent measurement that a sheet resistance between the separated antistatic films 6 and 6 is larger than $1\times10^{12}$ Ω/□.

The forming and activation are executed in a manner similar to the embodiment 1 and characteristics of the obtained electron source substrate are measured and evaluated by using the measuring and evaluating apparatus.

The voltage which is applied between the device electrodes 2 and 3 is set to the standard voltage of 17V, the scanning line voltage on the side of the X-directional wirings 10 at that time is set to −11V, and the signal line voltage on the side of the Y-directional wirings is set to +6V. The voltage which is applied between the anode electrode 164 and the electron source substrate is set to 1 kV and the measurement is performed. Thus, values of If=1.2 mA, Ie=1.2 μA, and the efficiency=0.10% are obtained. The voltage 6V is applied as a non-selection voltage to the electron-emitting devices which are not selected at this time. As a result of the measurement, the leakage current upon non-selection is equal to or less than 0.1 μA and this value is almost the same as that in the embodiment 1.

Embodiment 3

Figure 18:
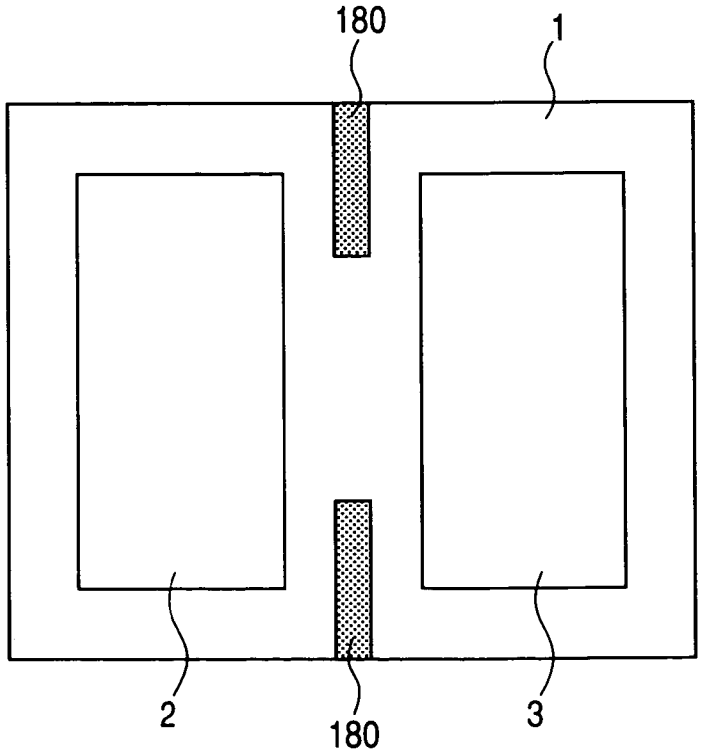
FIG. 18 is an explanatory diagram of a step of forming a high-impedance portion in an electron source substrate according to the embodiment 3 and is a schematic plan view showing a fundamental construction regarding a pair of device electrodes in the state where a substratum pattern has been formed on the substrate shown in FIG. 7 which is obtained after X-directional wirings were formed.
Figure 19:
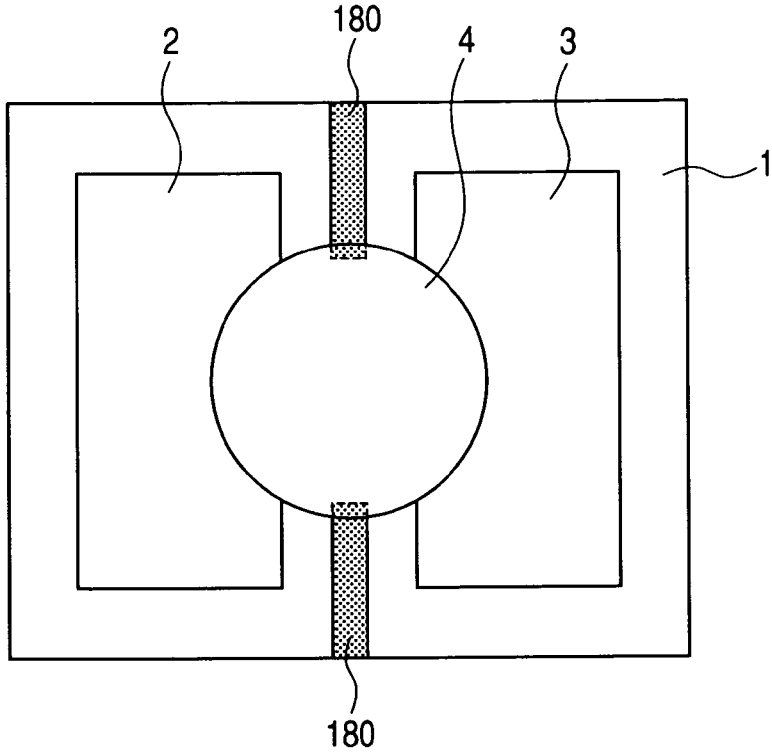
FIG. 19 is an explanatory diagram of the step of forming the high-impedance portion in the electron source substrate according to the embodiment 3 and is a schematic plan view showing the state where an electroconductive thin film has been formed between device electrodes on the substrate of FIG. 18.

With respect to the substrate 1 shown in FIG. 7 and obtained until the X-directional wirings 10 are formed after the device electrodes 2 and 3 were formed, an aluminum film having a thickness of about 500 nm is formed by aluminum sputtering. After that, it is coated with the photosensitive resist liquid by the spraying method, patterned, developed, and a substratum pattern 180 shown in FIG. 18 is formed on the developed film by aluminum etchant. After that, as already mentioned in the term of "creation of the electroconductive thin film", the interval between the device electrodes 2 and 3 is coated with the solution containing organic palladium by the ink-jet method, baked at 350° C. for 30 minutes, thereby forming the electroconductive thin film 4 shown in FIG. 19.

Figure 20:
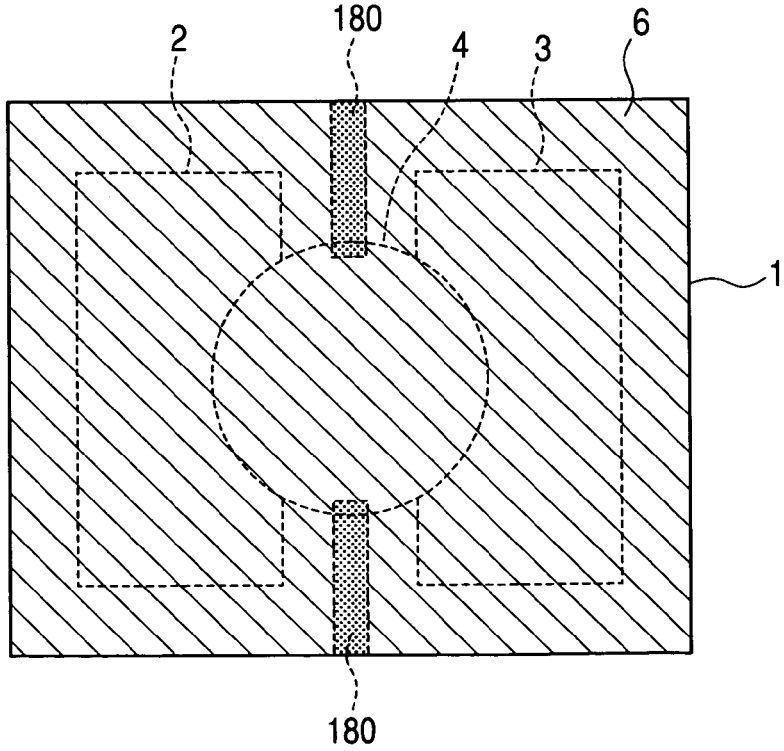
FIG. 20 is an explanatory diagram of the step of forming the high-impedance portion in the electron source substrate according to the embodiment 3 and is a schematic plan view showing the state where an antistatic film has been formed on the substrate of FIG. 19.

The whole surface of the film 4 is similarly coated with a coating liquid similar to that in the embodiment 2 from a position over the film 4 and baked at 200° C. for 20 minutes, thereby forming the antistatic film 6 as shown in FIG. 20.

Figure 21:
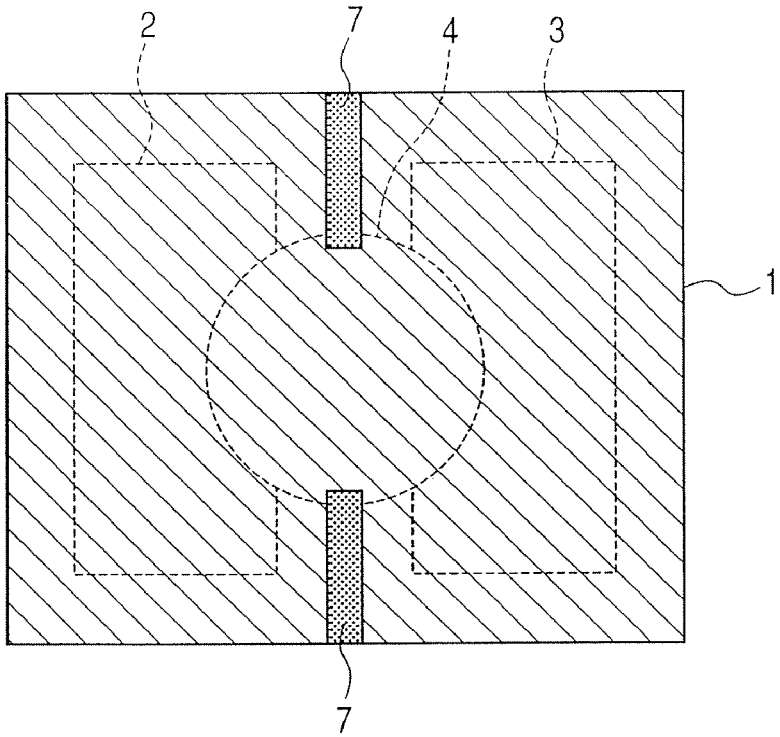
FIG. 21 is an explanatory diagram of the step of forming the high-impedance portion in the electron source substrate according to the embodiment 3 and is a schematic plan view showing the state where the substratum pattern has been removed from the substrate of FIG. 20.

After that, the substratum pattern 180 which has already been formed is completely removed by a peeling liquid and a part of the electroconductive thin film 4 formed on the aluminum film 180 and the antistatic film 6 are simultaneously removed so as to separate the area on the side of the device electrode 2 and the area on the side of the device electrode 3, thereby forming the high-impedance portion 7 shown in FIG. 21. It has been confirmed that the sheet resistance of the high-impedance portion 7 is larger than $1\times10^{12}$ Ω/□.

Subsequently, the forming and activation are executed in a manner similar to the embodiment 1.

By using the electron source substrate formed in accordance with the embodiment 3, characteristics are evaluated by using the characteristics evaluating apparatus shown in the embodiment 1. Thus, it has been confirmed that the leakage current upon non-selection is equal to or less than 0.1 μA and only a very weak leakage current flows into the driver IC for driving in a manner similar to the embodiments 1 and 2.

COMPARISON EXAMPLE

As a comparison example, with respect to the electron-emitting device with a construction similar to that in the embodiment 1 except that the high-impedance portion 7 is not formed in the antistatic film 6, characteristics are measured and evaluated by using the measuring and evaluating apparatus shown in the embodiment 1. Thus, the leakage current flowing upon non-selection reaches 1 mA and a phenomenon in which it further rises in association with the driving occurs.

Embodiment 4

According to this embodiment, a fissure serving as a high-impedance portion is formed in the antistatic film by the improvement of the forming process. A forming method of an electron source substrate in the embodiment 4 will be sequentially explained hereinbelow.

(Creation of the Substrate 1 and the Device Electrodes 2 and 3).

An $SiO_2$ film having a thickness of 100 nm is formed as a sodium block layer onto glass having a thickness of 2.8 mm of "PD-200" (made by Asahi Glass Co., Ltd.) in which a quantity of alkali components is small is used as a substrate 1 and the obtained substrate is used as an electron source substrate shown in FIG. 5. The device electrodes 2 and 3 are formed by the following method. That is, a Ti film having a thickness of 5 nm is formed as a substratum layer onto the glass substrate 1 by the sputtering method, a Pt film having a thickness of 40 nm is formed on the Ti film, and thereafter, the electrodes are formed by the photolithography method. An interval between the device electrodes 2 and 3 is set to 10 μM.

(Creation of the Y-Directional Wirings 8)

The Y-directional wirings (lower wirings) 8 are formed by a line-shaped pattern so as to be come into contact with one of the device electrodes 2 and 3 and couple them. A silver (Ag) photopaste ink is used as a material, screen-printed, and after that, dried, exposed to a predetermined pattern, and developed. After that, it is baked at a temperature of 480° C. and the Y-directional wirings 8 are formed. A thickness of each of the Y-directional wirings 8 is set to about 10 μm and a width is set to 60 μm.

(Creation of the Insulative Layer 9)

Subsequently, the insulative layer 9 is arranged so as to cover the crossing portions of the Y-directional wirings 8 which have been formed first and the X-directional wirings (upper wirings) 10, which will be explained hereinafter. At this time, contact holes are formed in the insulative layer 9 of the connecting portions so that the X-directional wirings 10 and the device electrodes 2 can be electrically connected. In this step, a photosensitive glass paste containing PdO as a main component is screen-printed and, thereafter, exposed and developed. Those processing steps are repeated four times and the insulative layer is finally baked at a temperature of 480° C. The whole thickness of insulative layer 9 is set to about 30 μm and a width is set to 150 μm.

(Creation of the X-Directional Wirings 10)

The X-directional wirings (upper wirings) 10 are formed by the following method. That is, the silver (Ag) photopaste ink is screen-printed onto the insulative layer 9 which has been formed first and, after that, dried. Similar processes are executed onto the insulative layer 9 again and it is painted twice and baked at a temperature of 480° C., thereby forming the X-directional wirings 10. The wirings 10 are connected to the device electrodes 2 in the contact hole portions of the insulative layer 9. A thickness of each of the X-directional wirings 10 is set to about 15 μm. Although not shown, leading terminals to the external driving circuit are also formed by a method similar to that mentioned above.

In this manner, the substrate 1 with the print pattern having the XY matrix wirings is formed.

(Creation of the Electroconductive Thin Film 4)

After the substrate 1 was cleaned, the surface is processed by using a water repellent agent so that the surface has hydrophobic property. After that, the electroconductive thin film 4 is formed between the device electrodes 2 and 3 by the ink-jet coating method.

In the embodiment, in order to form the electroconductive thin film 4 by the palladium film, first, a small amount of additive agent is added and a palladium complex is dissolved into a solvent comprising water and isopropyl alcohol (IPA), so that a solution containing palladium is obtained. A droplet of such a solution is adjusted so as to have a dot diameter of 60 μm and injected between the device electrodes 2 and 3 on the substrate 1 by the ink-jet injecting apparatus using the piezoelectric elements as droplet applying means. After that, the substrate 1 is heated and baked in the air at 350° C. for 10 minutes, thereby forming a thin film of palladium oxide (PdO). A diameter of PdO thin film is equal to about 60 μm and a maximum thickness is equal to 10 nm.

The palladium oxide film (PdO film) is formed as an electroconductive thin film 4 between the device electrodes 2 and 3 by the foregoing steps.

(Creation of the Antistatic Film 6)

Figure 23:
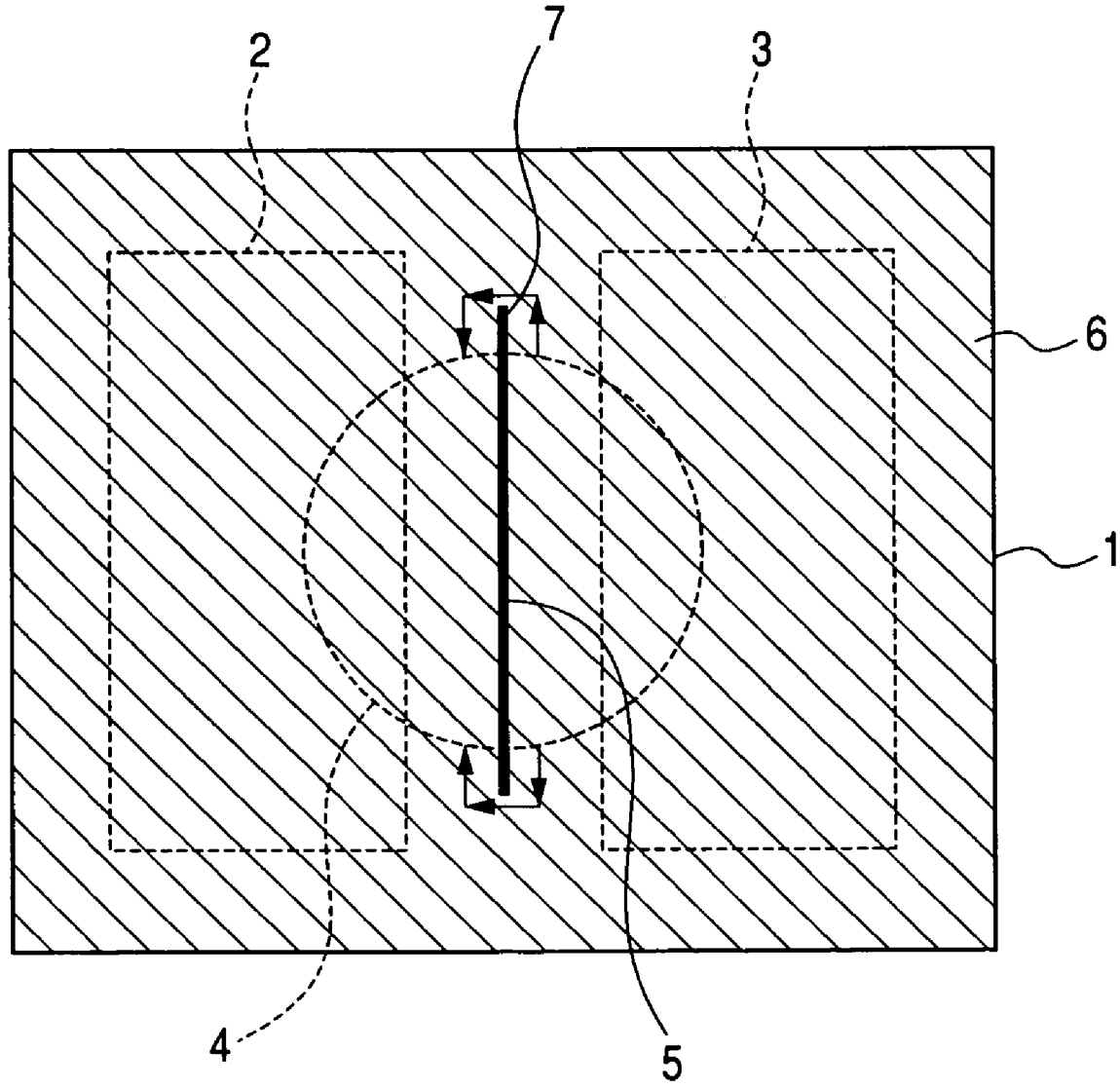
FIG. 23 is a schematic plan view showing a fundamental construction of an electron source substrate according to the embodiment 4.

Subsequently, a solution obtained by dispersing superminute particles containing tin oxide as a main component into an organic solvent (mixture liquid of isopropyl alcohol and ethyl alcohol) is sprayed onto the whole surface of the substrate 1 by a spray injecting apparatus. After that, a heat treatment is executed at 380° C. for 10 minutes, thereby forming the antistatic film 6 (refer to FIG. 23). A thickness of antistatic film 6 is adjusted to 30 nm as an average and a sheet resistance value is adjusted to $1\times10^{10}$ Ω/□. FIG. 23 shows the fissure 7 as a high-impedance portion 7 formed by processing steps, which will be explained hereinafter.

(Forming Step)

Subsequently, the forming step is executed.

In the state where the edge portions of the Y-directional wirings 8 and the X-directional wirings 10 are exposed as extraction electrodes around the substrate 1, the hood-shaped cap is put so as to cover the whole substrate 1 and the inner space between them is exhausted by the vacuum pump, thereby forming a vacuum space in the region between the substrate 1 and the cap. The inside is exhausted until the internal pressure reaches $2\times10^{-3}$ Pa. Further, the nitrogen gases in which 2% hydrogen is mixed are introduced. The voltage is applied between the X-directional wirings 10 and the Y-directional wirings 8 from the extraction electrode portions by the external power source and a current is supplied between the device electrodes 2 and 3, so that the gap 5 in the electrically high-resistance state is formed in the electroconductive thin film 4. The forming voltage is set to the waveform shown in FIG. 3A. In the embodiment, the pulse width T1 is set to 0.1 msec, the pulse interval T2 is set to 10 msec, the peak value is set to 10V, and the process is executed for about 20 minutes.

In the embodiment, after the above step was executed once, the additional forming is executed at the peak value of 12V as a condition of the higher voltage. By the additional forming process, the gap 5 of the electroconductive thin film 4 at the end time point of the above forming is allowed to reach the edge portion of the electroconductive thin film 4 (contact portion with the antistatic film 6). The gap interval in the edge portion of the electroconductive thin film at this time is equal to about 50 nm.

As a condition of the additional forming, it is important to set the condition of the higher power. As a condition other than the condition in which the higher voltage is set, a method whereby the pulse width is widened more, the pulse interval is shortened, or the like can be also used. When a sample obtained at the time point of the end of the additional forming is extracted and the gap 5 of the electroconductive thin film 4 is observed by a scanning electron microscope, it has been confirmed that the gap 5 reached the edge portion of the electroconductive thin film 4 (contact portion with the antistatic film 6).

(Activating Step)

The process called activation is executed to the electron-emitting device.

In a manner similar to the foregoing forming process, a vacuum space is formed and the pulse voltage is repetitively applied to the device electrodes 2 and 3 from the outside through the X-directional wirings 10 and the Y-directional wirings 8.

In this step, trinitrile is used as a carbon source and introduced into the vacuum space between the hood-shaped cap and the substrate 1 through the slow leakage valve, and the pressure of $1.3\times10^{-4}$ Pa is maintained. The pressure of trinitrile which is introduced is preferably set to about $1\times10^{-5}$ to $1\times10^{-2}$ Pa although it is slightly influenced by the shape of the vacuum apparatus, the members used in the vacuum apparatus, or the like.

The voltage which is applied is set to the waveform as shown in FIG. 4A, the pulse width T1 is set to 1 msec, the pulse interval T2 is set to 10 msec, and the peak value is set to 16V.

The energization is stopped at a point when the device current If reaches almost the saturation value after about 60 minutes, the slow leakage valve is closed, and the activating process is finished. When the gap 5 of the electroconductive thin film 4 at the point of time when the activation is finished is observed, it has been confirmed that the gap 5 reached the area of the antistatic film 6 (refer to FIG. 23) adjacent to the electroconductive thin film 4 and the fissure 7 was formed.

The electron source substrate having a plurality of electron-emitting devices can be formed by the above steps.

In the embodiment, since the additional forming step is executed at the time of the forming step, the gap 5 can be formed up to the edge portion of the area of the electroconductive thin film 4. Therefore, upon activation, the fissure 7 can be certainly formed in the antistatic film 6 (refer to FIG. 23) adjacent to the outside of the area of the electroconductive thin film 4. A length of fissure 7 formed in the antistatic film 6 is equal to about 250 nm.

With respect to the electron-emitting device formed by the manufacturing method as mentioned above, the emission current Ie and the device current If are measured by the measuring and evaluating apparatus shown in FIG. 16. With respect to the electron-emitting device manufactured in the embodiment, the emission current Ie at the voltage (Vf=12V) applied across the device electrodes 2 and 3 is measured. Thus, the average emission current is equal to 0.6 μA, average electron emissivity is equal to 0.15%, and the device current If in the case where applied voltage Vf across the device electrodes 2 and 3 is equal to 5V corresponding to the current flowing between the device electrodes 2 and 3 in the non-selection mode (non-driving mode) is equal to 0.01 μA.

The conventional electron-emitting device in which the gap 5 has been formed only in the electroconductive thin film 4 and does not reach the area of the antistatic film 6 (refer to FIG. 23) adjacent to the electroconductive thin film 4 is measured. The device current If in the case where applied voltage Vf across the device electrodes 2 and 3 is equal to 5V corresponding to the current flowing between the device electrodes 2 and 3 in the non-selection mode is equal to 0.02 μA.

Figure 22:
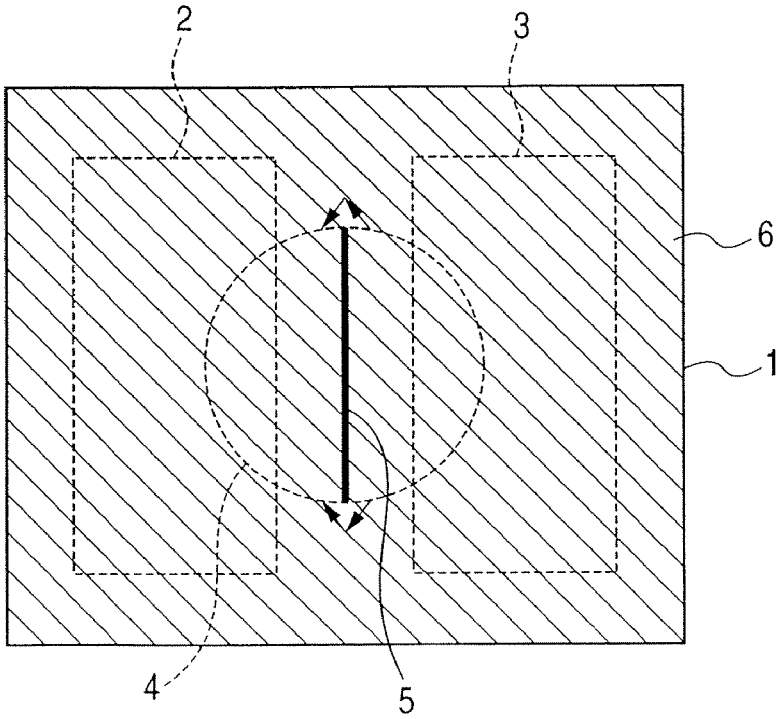
FIG. 22 PRIOR ART
FIG. 22 is an explanatory diagram of a conventional electron source substrate.

In the electron source substrate according to the embodiment, electrons are emitted from an area near the gap 5 by applying the voltage across the device electrodes 2 and 3. However, since the gap 5 has arrived as a fissure 7 not only in the electroconductive thin film 4 but also at the area of the antistatic film 6 adjacent to the electroconductive thin film 4, as shown by arrows in FIG. 23, a path of the current flowing in the antistatic film 6 adjacent to the electroconductive thin film 4 has to bypass the fissure 7. Thus, a distance of such a current path is longer than that of the path in the conventional electron source substrate shown in FIG. 22. Moreover, since the resistance value of the antistatic film 6 is a few digits larger than that of the electroconductive thin film 4, the leakage current flowing in the antistatic film 6 adjacent to the electroconductive thin film 4 is extremely decreased as compared with that of the conventional electron source substrate.

Although the case where the gap 5 has reached the antistatic film 6 and the fissure 7 is formed has been described above, it is not always necessary that the fissure 7 is formed as an extension of the gap 5 so as to have almost the same width and depth as those of the gap 5. The fissure 7 can be formed, for example, only on the surface of the antistatic film 6, in other words, it can be formed with a depth which does not reach the surface of the substrate 1 or can be also formed with a width that is narrower or wider than the gap 5. It is a feature of the embodiment that the high-impedance portion connecting to the gap 5 of the electroconductive thin film 4 is formed in the antistatic film 6 and the state where the leakage current flowing in the antistatic film 6 of the portion adjacent to the gap 5 is decreased is accomplished, and it is not always necessary that the high-resistance portion is formed as an extension of the gap 5.

It is preferable that a length of fissure 7 is equal to or larger than 5 times of the interval at the edge portion of the gap 5. Thus, the value of the current flowing in the antistatic film 6 can be decreased to 1/10 or less as compared with that in the case where there is no fissure 7.

According to the image-forming apparatus of the invention manufactured in a manner similar to the foregoing other embodiment, the electrons are emitted by applying the voltage to the electron-emitting devices through the Y-directional wirings 8 and the X-directional wirings 10, a high voltage is applied to the metal back 63 as an anode electrode from the high-voltage terminal 66, the electron beam is accelerated, and the beam is made to collide with the phosphor film 62, thereby enabling the image to be displayed.

The foregoing image-forming apparatus can keep high display quality.

According to the electron source substrate of the invention, since the high-impedance portion is provided for the antistatic film, the leakage current caused between the device electrodes in the non-selection voltage applying mode can be prevented and the electric power consumption can be suppressed. Since the leakage current can be prevented, the electron source having high electron emissivity (ratio of the emission electrons (current which is emitted) to the current flowing across the device electrodes) can be obtained. Therefore, in the image-forming apparatus using such an electron source substrate, a driver IC having a large capacity in consideration of the leakage current does not need to be used as a driver IC. By using a driver IC having a small capacity, the costs can be reduced. Particularly, in the embodiment in which the fissure serving as a high-impedance portion has been formed in the antistatic film adjacent to the electroconductive thin film so as to be continuous with the gap of the electroconductive thin-film serving as an electron-emitting region, when the current flows in the antistatic film adjacent to the electroconductive thin film, it flows while bypassing the fissure. The current path is longer than that in the case where the fissure serving as a high-impedance portion does not exist. Thus, the leakage current flowing in the antistatic film adjacent to the electroconductive thin film can be remarkably decreased.

This application claims priority from Japanese Patent Application Nos. 2004-066554 filed Mar. 10, 2004 and 2004-068376 filed Mar. 11, 2004, which are hereby incorporated by reference herein.

What is claimed is:

1. An electron source substrate comprising:

a substrate;

an electron-emitting device having a pair of device electrodes locating on said substrate and an electroconductive thin film which is provided between said device electrodes and has a gap serving as an electron-emitting region; and an antistatic film which is in contact with at least said pair of device electrodes and covers over an exposed surface of said substrate, wherein an impedance portion which obstructs a current caused between said pair of device electrodes through said antistatic film is formed on said antistatic film.

2. An electron source substrate according to claim 1, wherein the high-impedance portion of said antistatic film has a sheet resistance value which is 100 or more times as large as that of the antistatic film adjacent to said impedance portion.

3. An electron source substrate according to claim 2, wherein said antistatic film is in contact with an outer edge of said electroconductive thin film and said impedance portion is a fissure which is continuous with a gap.

4. An electron source substrate according to claim 2, wherein the impedance portion of said antistatic film has a sheet resistance value larger than $10^{12}$ Ω/□.

5. An electron source substrate according to claim 2, wherein the impedance portion of said antistatic film is formed as a thinner film portion or a discontinuous portion of the antistatic film.

6. An electron source substrate according to claim 2, further comprising:

a plurality of said electron-emitting devices; and

X-directional wirings and Y-directional wirings which are connected to each of said electron-emitting devices and formed in the directions which cross each other.

7. An image-forming apparatus in which the electron source substrate according to claim 6 and a substrate having an image-forming member which displays an image by irradiation of an electron beam from said electron source substrate are arranged so as to face each other.

* * * * *